US011098524B2

(12) United States Patent
Gendrone

(10) Patent No.: US 11,098,524 B2
(45) Date of Patent: Aug. 24, 2021

(54) WINDOW PAN DRAINAGE SYSTEM

(71) Applicant: Michael Oscar Gendrone, Calgary (CA)

(72) Inventor: Michael Oscar Gendrone, Calgary (CA)

( * ) Notice: Subject to any disclaimer, the term of this patent is extended or adjusted under 35 U.S.C. 154(b) by 117 days.

(21) Appl. No.: 16/376,689

(22) Filed: Apr. 5, 2019

(65) Prior Publication Data

US 2019/0234137 A1 Aug. 1, 2019

Related U.S. Application Data

(63) Continuation-in-part of application No. 14/121,604, filed on Sep. 24, 2014.

(51) Int. Cl.
*E06B 7/14* (2006.01)
*E06B 1/70* (2006.01)

(52) U.S. Cl.
CPC ..... *E06B 7/14* (2013.01); *E06B 1/702* (2013.01)

(58) Field of Classification Search
CPC ..... E06B 1/70; E06B 1/705; E06B 2001/707; E06B 1/702; E06B 7/14
USPC ..... 52/58, 60
See application file for complete search history.

(56) References Cited

U.S. PATENT DOCUMENTS

| | | | |
|---|---|---|---|
| 8,443,554 | B1 | 5/2013 | Teodorovich |
| 8,695,293 | B2 | 4/2014 | Teodorovich |
| 2005/0055912 | A1 | 3/2005 | Teodorovich |
| 2005/0144856 | A1 | 7/2005 | Conlin |
| 2005/0166471 | A1 | 8/2005 | Allen |
| 2006/0156639 | A1 | 7/2006 | Allen |
| 2009/0272045 | A1 | 11/2009 | Teodorovich |
| 2010/0058683 | A1 | 3/2010 | Bushberger |
| 2010/0139178 | A1 | 6/2010 | Ehrman et al. |

*Primary Examiner* — William V Gilbert

(57) ABSTRACT

A system and components for a window pan water dam system is disclosed. The object of the invention is to deflect water from the window base sill plate back towards the exterior drainage plain of the building envelope, thus ensuring water ingress does not occur through the sill pan area and the side walls of the opening.

19 Claims, 26 Drawing Sheets

WINDOW PAN DRAINAGE SYSTEM

CROSS REFERENCE TO RELATED APPLICATIONS

This is a continuation in part application of U.S. patent application Ser. No. 14/121,604 filed on Sep. 24, 2104, the contents of which is incorporated herein by reference.

FIELD

The invention relates to a system/assembly (and components) for a window pan drainage dam system it manages moisture and water build-up by redirecting the water or moisture away from the interior of a building redirecting it to the exterior building envelope drainage plain thus redirecting moisture away from the window pan area. The object of the invention is to provide a consistent durable product that does not rot, it is user friendly to install uniformly designed for ease of inspection, promoting drainage to the exterior building envelope.

BACKGROUND

Window openings of buildings are of reinforced concrete, steel, wood and concrete like materials have window openings in various locations of the buildings structural exterior walls. The window openings in a building must integrate with the exterior building envelope to protect the penetrations and exterior of the building structure as a whole. Building envelope is meant to protect the building's structure from water ingress, wind and thermal transfer that causes structural damage, mold, rot and general decay of a building and its structure.

Certain types of walls of buildings have an inner cavity between the outside cladding and the inner wall consisting of plasterboard material. The said cavity permits air movement with the outside atmosphere to provide an air equalization chamber, a thermal break and moisture vent conduit for moisture infiltration through the exterior cladding. Over time by action of wind, rain, temperature freeze and thaw small cracks on the exterior of buildings and or the windows themselves allows further water infiltration and condensation (wicking affect) of that first defence is realised and defeated. The window pan drainage dam system is tied into the components (peal and stick membrane/primer) of a buildings envelope ensures water ingress and condensation that occurs by thermal conditions in the window pan area are directed away from causing building failure of the window pan area.

SUMMARY

It is conceived to deflect water from the window base sill plate back towards the exterior drainage plain of the building envelope, thus ensuring water ingress does not occur through the sill pan area and the side walls of the windows opening.

A window pan drainage dam assembly for a windows sill plate may be made from light weight PVC. The assembly may comprise of a PVC extruded sill strip that slopes from back to front when installed on a sill plate, such as with nails or screws to butt up to left and right universal 90 degree sloped corner dams that may be injection molded and may also be comprised of PVC, creating a finished dam system for the sill plate and the vertical wall of the window opening that may extend upwards at least 4 inches. Universal injection molded corner dams and the center extruded dam strip may have hollow areas to restrict buckling and warping.

The window drainage dam assembly may comprise of a wide range of single component plastics and mixtures of plastic materials including but not limited to: PVC based, Polystyrenes based, Rubber based, Silicone based, Wood based and Fibreglass based of various widths with a back to front sloped profile.

The window pan drainage dam assembly may also include but is not limited to a single component of galvanized steel, metal products, manmade compositions, Composite materials natural or manmade, of various sizes with a back to front sloped profile.

The window pan drainage dam assembly of claim can maintain a back to front profile and height dimensions however the width dimensions and slope can vary to accommodate different wall assemblies and rough openings that are of various sizes and widths.

The window pan drainage dam assembly may be manufactured by means of Manual fabrication, Extrusion, Mold injection, casting, 3D printing, CNC fabrication or Templating.

The window pan drainage dam assembly elements may communicate with each other to form a continuous window pan drainage dam profile from end to end of the sill plate with the universal corner dams ensuring the system extends up the vertical studs of the rough opening at least 4 inches providing protection from wicking moisture and condensation.

The window pan drainage dam assembly may be mechanically fastened to the sill plate and the left and right wall stud of the rough opening.

The window pan drainage dam assembly which is ready for primer, oil or latex based and for its peal and stick membrane or self-adhesive peal and stick membrane, this seals the pan area and the dam system.

The window pan drainage dam assembly can form a complete uninterrupted seal thus allowing the assembly to properly manage the moisture and water ingress occurring in a window pan area readying the window to be installed.

The window pan drainage dam assembly of claim may channel and permit moisture to drain and air to circulate to effectively allow a window pan area to dry itself.

In another embodiment, there is provided a window pan drainage system comprising:

a) a sill strip including a top surface sloped relative to a horizontal plane defined by a length direction and a width direction and a bottom surface comprising a plurality of first rib structures spaced apart from each other and configured to support the sill strip;

b) a right corner dam having an L-configuration including a lower top surface sloped relative to a horizontal plane defined by the length direction and the width direction, an upper top surface sloped relative to a horizontal plane defined by a height direction and the width direction, a lower bottom surface comprising a plurality of second rib structures spaced apart from each other and an upper bottom surface comprising a plurality of third rib structures spaced apart from each other, the second and third rib structures configured to support the right corner dam; and c) a left corner dam having an L-configuration including a lower top surface sloped relative to a horizontal plane defined by the length direction and the width direction, an upper top surface sloped relative to a horizontal plane defined by the height direction and the width direction, a lower bottom surface comprising a plurality of fourth rib structures spaced apart from each other and an upper bottom surface comprising a plurality of fifth rib structures spaced apart from each other, the fourth and fifth rib structures configured to support the right corner dam.

According to another embodiment, there is provided a method for preventing water intrusion for a window assembly having a window sill with an interior-facing side and an exterior-facing side comprising:

a) placing the water pan drainage system of claim 1 horizontally flat on the window sill so that the upper top surface of the sill strip, the upper and lower top surfaces of the right corner dam and the upper and lower bottom top surfaces of the left corner dam slope towards the exterior-facing side; and b) coupling the water pan drainage system to the window sill.

BRIEF DESCRIPTION OF THE DRAWINGS

The structure, operation, and advantages of the present invention will become further apparent upon consideration of the following description taken in conjunction with the accompanying figures. The figures are intended to be illustrative, not limiting. Certain elements in some of the figures may be omitted, or illustrated not-to-scale, for illustrative clarity. The cross-sectional views may be in the form of "slices", or "near-sighted" cross-sectional views, omitting certain background lines which would otherwise be visible in a "true" cross-sectional view, for illustrative clarity.

DETAILED DESCRIPTION

Figure 1:
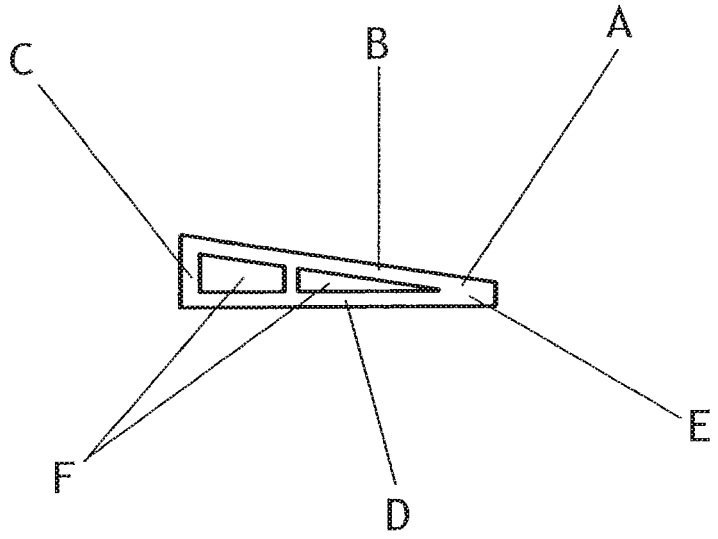
FIG. 1 shows the end profile view of the sill strip that has a slope to shed and promote water drainage.
Figure 2:
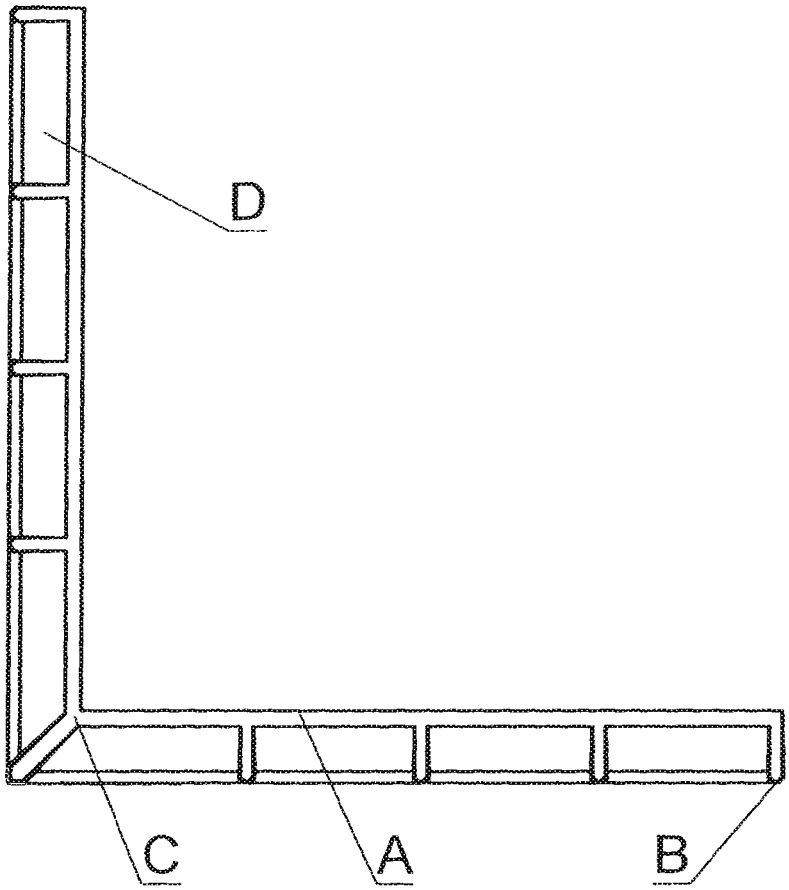
FIG. 2 shows the universal corner that is sloped on both the base and its vertical side directing and forcing water and condensate back down into the pan area not allowing it to reverse into the building's interior.

FIG. 1 illustrates a side profile of the center extruded dam strip A. Formed by extrusion of PVC vinyl or various combinations of plastic materials B. Identifies the slope of the dam from back to front this slope can vary in degree of slope depending on the width of a pan area C. This is the rear of the center strip the height of this is ⅜" no matter the width of the center dam strip D. This is the base portion of the dam and maintains a flat horizontal profile E. This is the front of the center strip this height is constant no matter the width of the center dam strip. FIG. 2 illustrates a side view of the universal corner dam A Formed by the method of injection molding with a PVC vinyl or various combinations of plastic materials B. This shows the base of the corner and identifies it's slope from back to front slope can vary in degree of slope depending on the width of a pan area C This shows the vertical portion of the universal corner that is slope with the same degree as the base of the corner or other various sizes of the center dam strip D This is the front of the universal corner this height is constant no matter the width of the center dam strip E This is the rear of the center strip the height of this is ⅜" no matter the width of the center dam strip.

Figure 3:
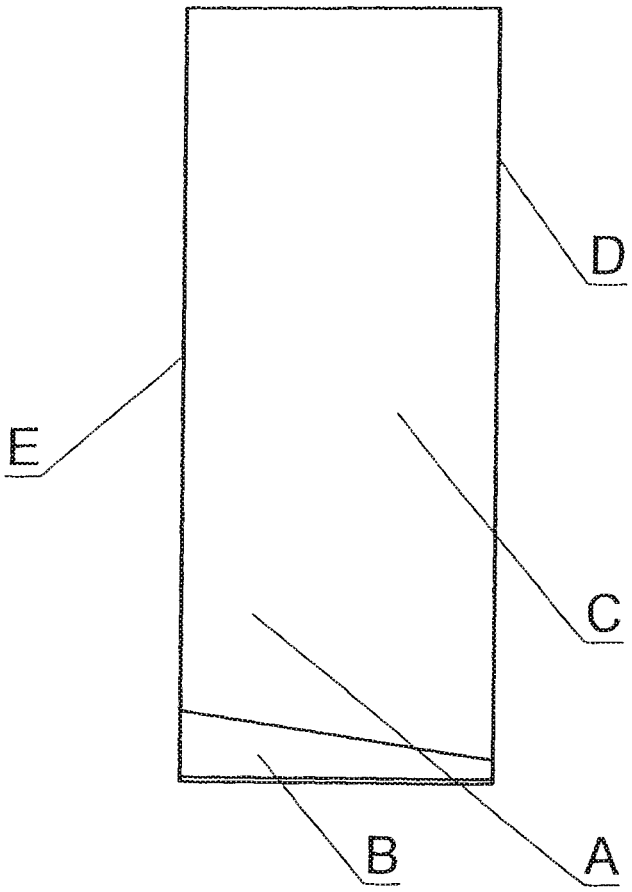
FIG. 3 shows the back view of the universal corner.

FIG. 3 Illustrates a rear view of the Universal corner dam A Formed by the method of injection molding with a PVC vinyl or various combinations of plastic materials B this is a support leg of which there are 8 in total 4 for the horizontal portion of the corner and 4 for the universal vertical portion of the universal corner dam C This is a support leg for the universal corner dam D this represents hollow portions of the corner. This eliminates the base portion that is require for the center dam strip.

Figure 4:
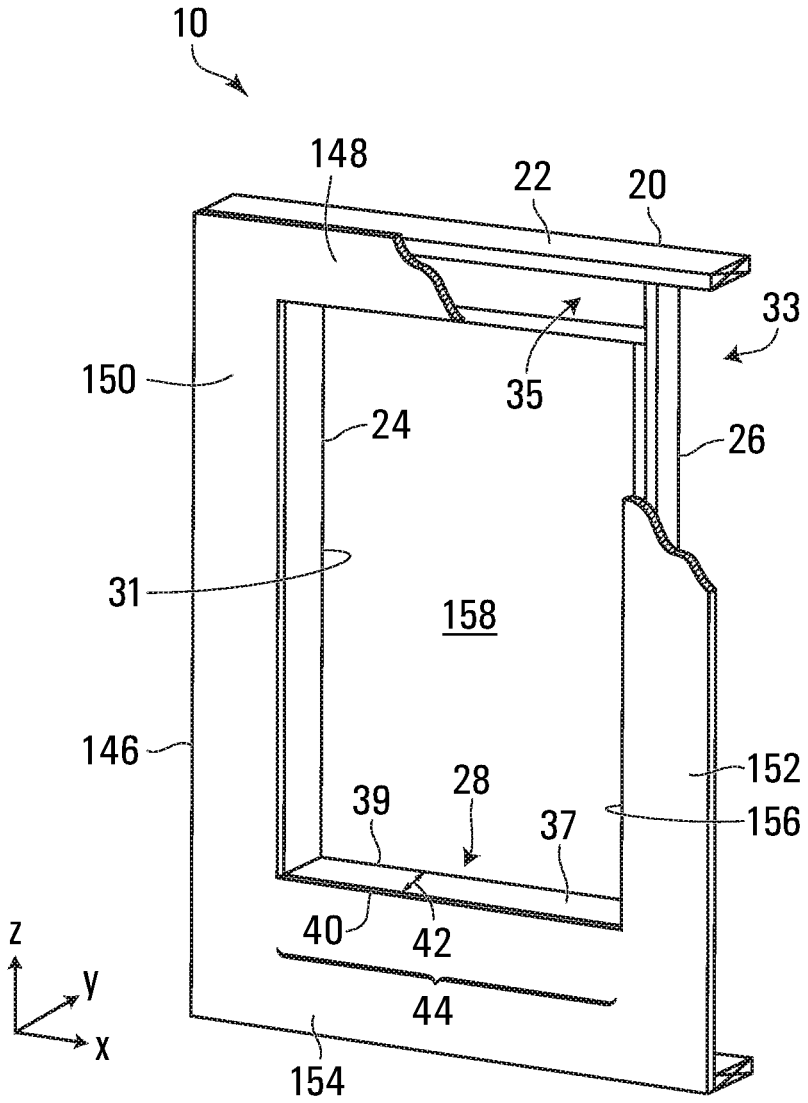
FIG. 4 is a perspective view of a window assembly in part, including a window frame.

FIG. 4 illustrates a perspective view of a partial window assembly 10 in which the window pan drainage system may be installed to prevent water intrusion into a building structure opening. The partial window assembly 10 includes a generally rectangular window frame 20 that may be composed of wood. The window frame 20 includes a top portion, 22, a first side portion 24, a second side portion 26 and a bottom portion or window sill 28, all of which collectively define a frame opening 31 for receiving a window. In the illustrated embodiment, the frame opening 31 is illustrated as rectangular, although the window frame 20 may define a variety of different window openings with different shapes (e.g. square, polygonal, arched top) and varying dimensions. While embodiments, of the window pan drainage system of the present disclosure are shown and described herein for use in a window opening in a building structure, one skilled in the art will understand that the window pan drainage system may also be used in connection with a door or other opening in a wall for any type of structure, such as, but not limited to, a door sill, a door, a patio sill, a patio door, a revolving door, a rotating door, a pet door or other portal structure.

The frame 20 includes an interior side 33, configured to face an interior of the building to which the frame is installed, and an oppositely facing exterior side 35. The window sill 28 includes a horizontal top surface or sill surface 37, with an interior end 39, an exterior end 40, a sill depth 42 defined between the interior end 39 and the exterior end 40, and a sill length 44 defined between the first side portion 24 and the second side portion 26 of the frame 20.

A structural panel 146 is coupled to the exterior side 35 of the frame 20. The structural panel 146 may comprise a single sheet with a top panel portion 148, a first side portion, or first jamb, 150, a second side portion, or second jamb, 152, and a bottom board portion 154, all of which define a panel opening 156 that substantially conforms to, and aligns with, the frame opening 31. Thus, the panel opening 156 and the frame opening 31 collectively define a window opening 158 for receiving a window. The structural panel 146 may be composed of natural wood, or engineered board material such as oriented strand board ("OSB").

As used herein, the length direction corresponds to the dimension between the first and second side portions 24 and 26 (see the X-axis in FIG. 4). The width direction corresponds to the dimension through the opening 158 perpendicular to the length (see the Y-axis in FIG. 4). Lastly, the height direction corresponds to the vertical dimension (see the Z-axis in FIG. 4).

Figure 5:
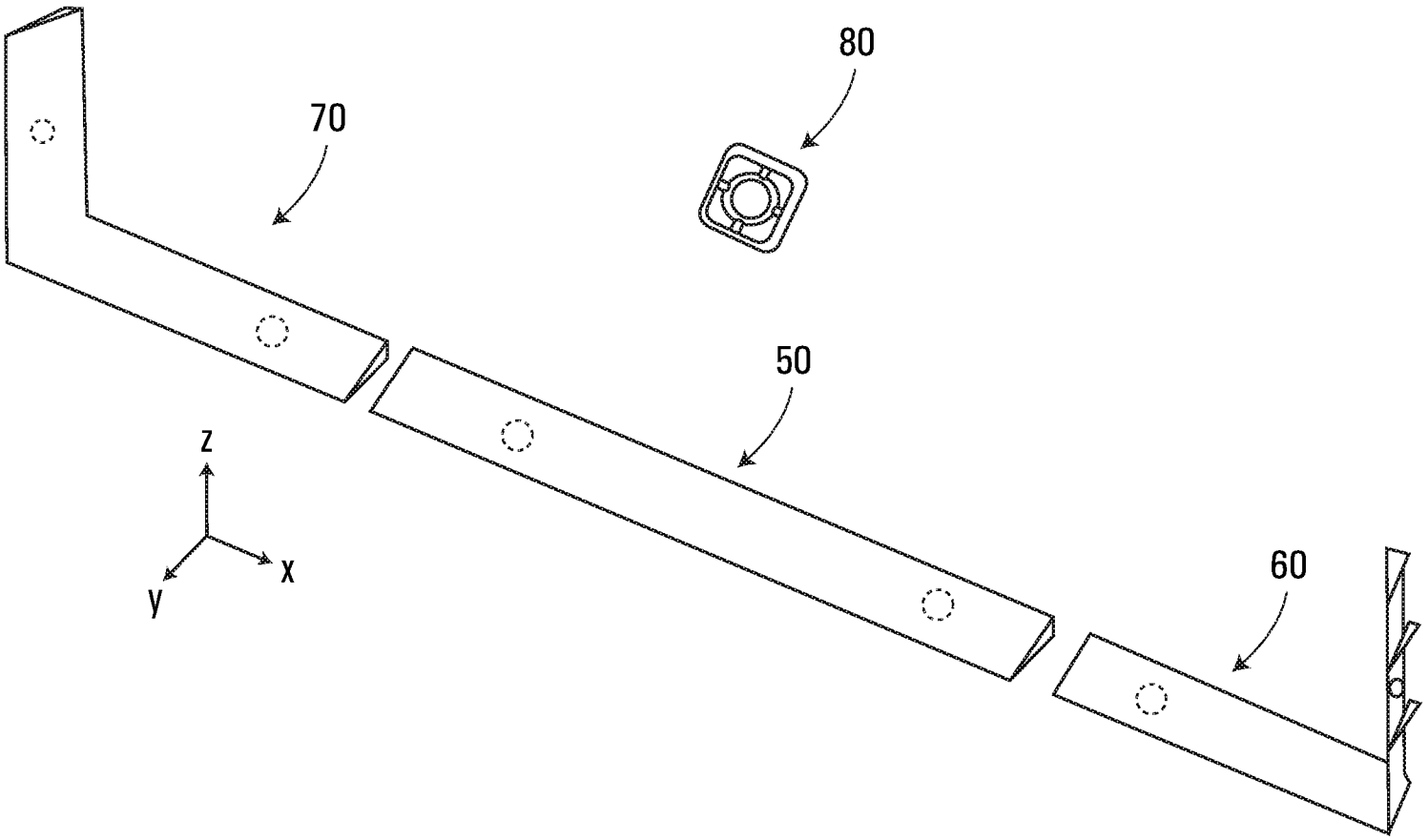
FIG. 5 is an exploded view of a window pan drainage system according to one embodiment of the present disclosure.

FIG. 5 illustrates the various components of the window pan drainage system 40 according to one embodiment of the present disclosure. The components of the window pan drainage system 40 generally include a sill strip 50, a right corner dam 60 and a left corner dam 70. If needed, one or more shims 80 may also be used to help level one or more of the various components when installed in the window frame 20. The use of left and right as reference designations herein is for convenience in describing the embodiments and is not intended to limit the embodiments in any preferred location or orientation. Further, the depiction herein of a sill strip and left and right corner dams is not intended to foreclose the presence of additional sill strip and/or corner dam segments that may overlap or abut such segments. Moreover, the depiction of the sill strip and left and right corner dams as separate segments is not intended to foreclose the integration of such segments into a unitary structure or other combination (e.g. a sill strip integrated with a corner dam or sill strips integrated with one another). Additionally, it can be seen, with reference to FIG. 5 that although the description is illustrated with particular reference to the right corner dam 60, in one embodiment the left corner dam 70 will commonly exhibit a generally symmetrical configuration relative to an orthogonal axis therebetween. Thus, generally the description provided for one corner dam covers like structures for the opposing corner dam. However, it is to be borne in mind that the right corner dam 60 and the left corner dam 70 need not always be generally symmetrical, but may vary with respect to one another in or more or more respects, such as, but not limited to, shape, dimension, material, or other attribute.

The components of the window pan drainage system 40 may each have a unitary structure that, in one embodiment, may be made from a plastic sheet or film, including, but not limited to, a polyester (in particular polyethylene terephthalate, PET, polybutylene terephthalate, PBT, polyethylene naphthalate, PEN, polylactic Acid, PLA, polyhydroxybutyrate and their copolymers), polyamide (in particular PA 6, PA 6.6, PA 6.10, PA 6.12, PA 11, PA 12 and their copolymers), polyethylene (PE) in all its variations, based on density, molecular weight or branching (for example: low, medium or high density, linear or branched, high, ultra-high, low, ultra-low molecular weight and all their combinations), polypropylene, polycarbonate (PC), polystyrene (PS), polymethylmethacrylate (PMMA, including its modifications with comonomers such as methacrylic acid, acrylate, butyl acrylate), acrylonitrile butadiene styrene (ABS), polyvinylchloride, polyether sulfone, polyetherether ketone, polyetherimide, polyphenyleneoxide and other less common grades of plastic sheets or film. In another embodiment, each of the components of the window pan drainage system 40 may be thermoformed from the plastic sheet or film or injection molded from plastic pellets while in still other embodiments, one or more of the components may be 3-D printed.

The components of the window pan drainage system 40 may be further characterized as including one or more variations in topography along their top surface, bottom surface or both. For example, as will be discussed below, the sill strip 50 and left and right corner dams 60, 70 may be shaped to define a plurality of rib structures along substantially all, or only a portion of (for e.g. less than 90% or less than 80% or less than 70% or less than 60% or less than 50% or less than 40% or less than 30% or less than 20% or less than 10%) their bottom surfaces. The components may also include along their top and/or bottom surfaces marking indicia including, but not limited to, a trademark or other source designator, product use instructions, product recycling designations, measuring aids (e.g. markings of measurement units), leveling indicators, side designations (e.g. left, right, up, down, or otherwise), fastener locators or apertures, patent markings and any combination thereof.

Figure 6A:
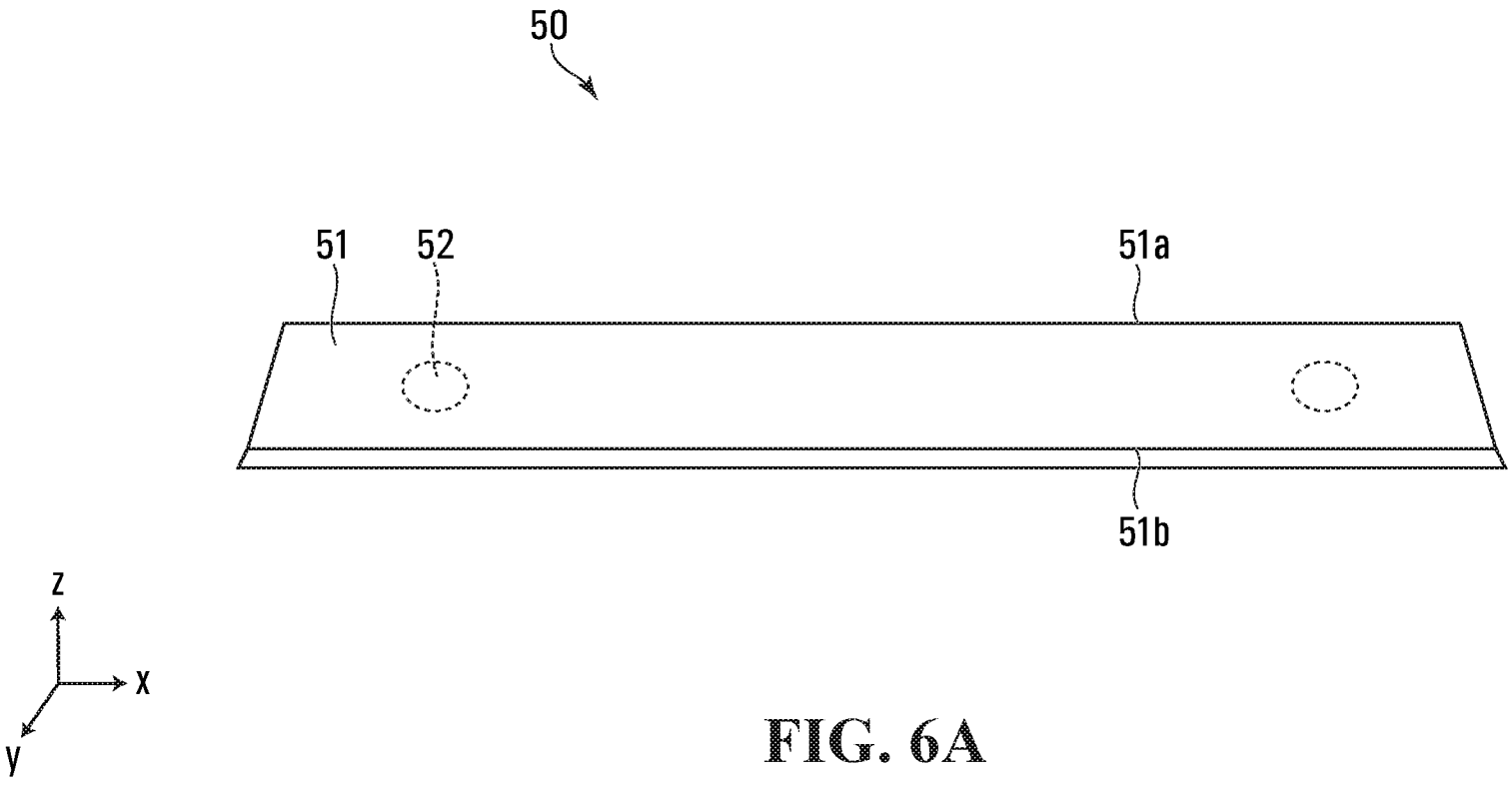
FIG. 6A is a front view of a sill strip that is a component of the window pan drainage system of FIG. 5.
Figure 6B:
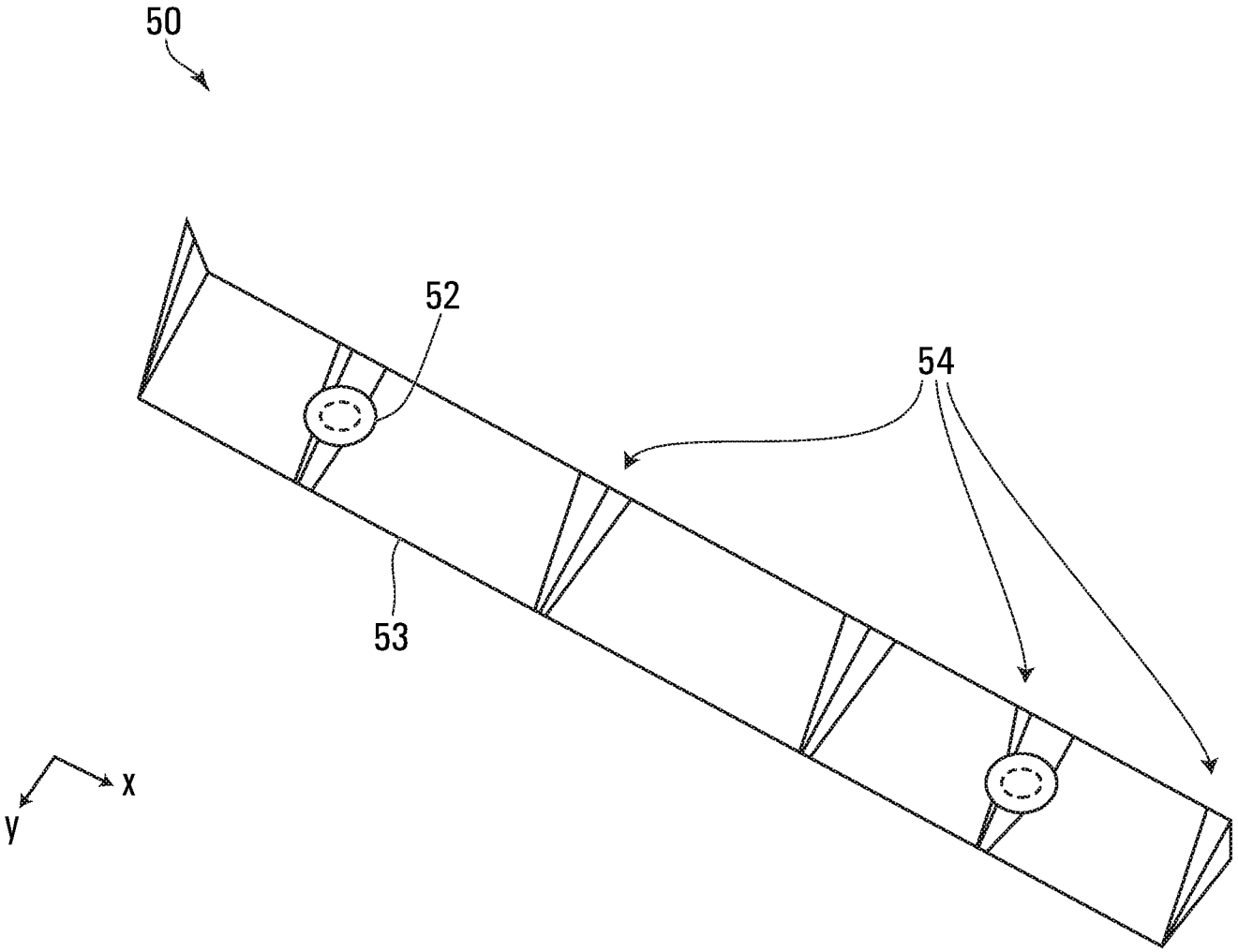
FIG. 6B is a bottom perspective view of a sill strip that is a component of the window pan drainage system of FIG. 5.
Figure 9:
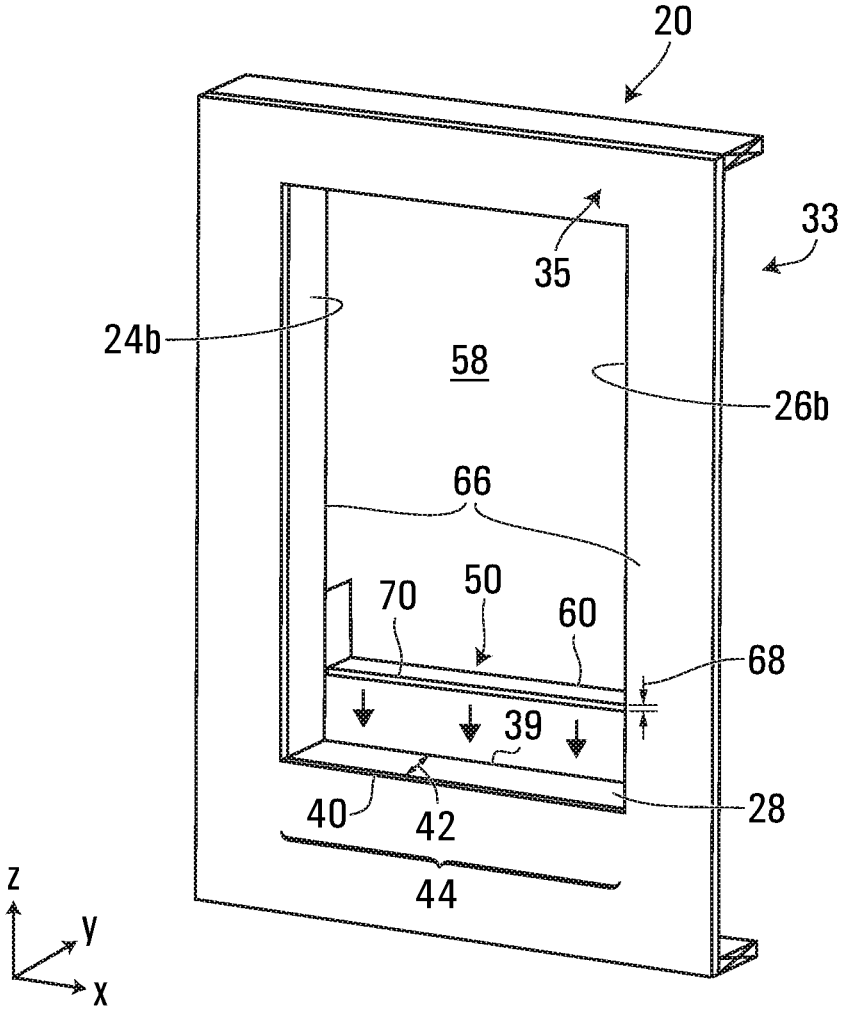
FIG. 9 is a perspective view of a window assembly in part showing placement of the window pan drainage system of FIG. 5.

With reference to FIGS. 6A and 6B, according to one embodiment the sill strip 50 may include a top surface 51, at least one fastener locator or aperture 52, and a bottom surface 53 comprising a plurality of rib structures 54 spaced apart from each other to support the sill strip 50. The top surface 51 of the sill strip 50 may be configured for draining water or moisture away from the interior side 33 to the exterior side 35 when installed in window frame 20 as shown in FIG. 9. Thus, the top surface 51 may be continuously sloped relative to a horizontal plane defined by the length and width directions (X- and Y-axis). To provide the top surface 51 with the desired slope, the bottom surface 53 may have a plurality of rib structures 54 extending downward from the bottom surface 53. The height of the rib structure 54 is tapered toward the exterior side 40 of window sill 28 along the width direction (Y-axis). Therefore, when the rib structures 54 rest on a substantially horizontal window sill 28, the top surface 51 is oriented with a slope (downward) toward the exterior side 40 of the window sill 28.

Figure 7A:
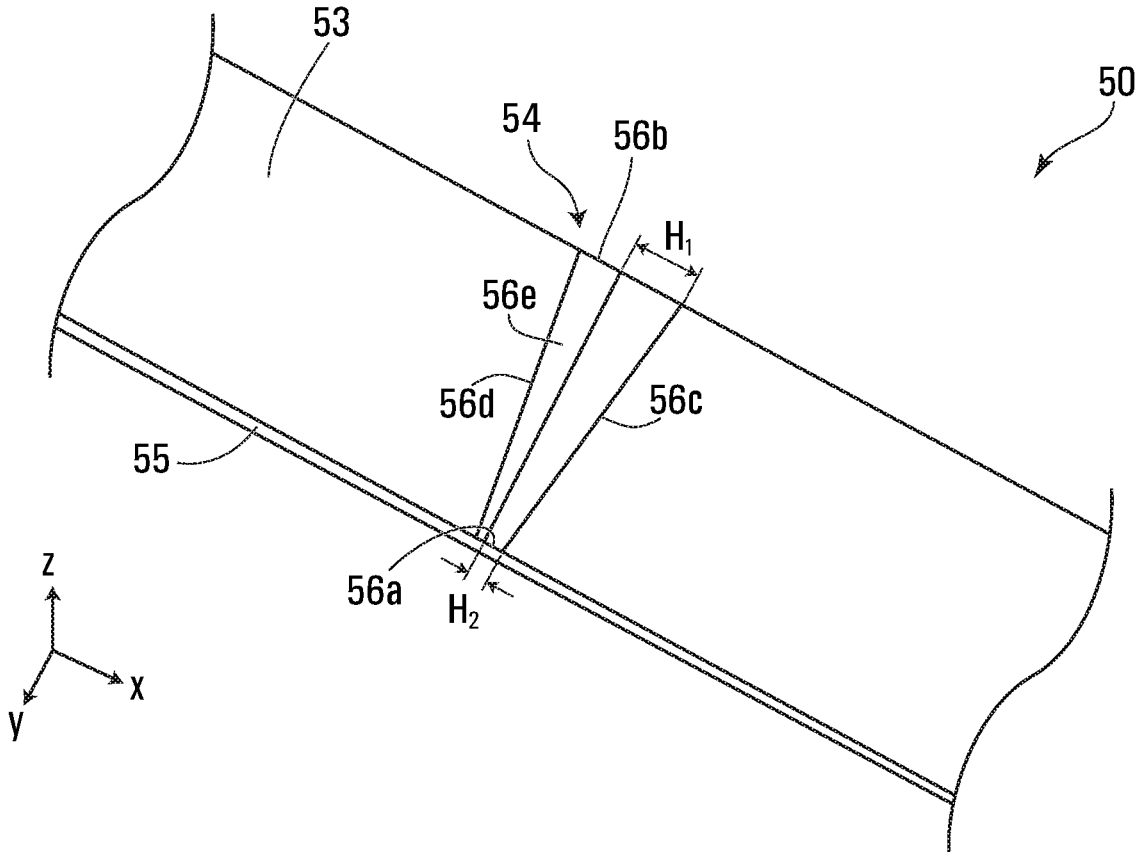
FIG. 7A is an enlarged perspective view of the rib structure of the sill strip that is a component of the window pan drainage system of FIG. 5.

With reference to FIG. 7A, there is shown in enlarged detail one example of a rib structure 54 on the bottom surface 53 of the sill strip 50. According to one embodiment, the rib structure 54 is positioned along substantially all of the width direction (Y-axis) of the bottom surface 53 of the sill strip 50. Also shown in FIG. 7A is a front wall 55 adjacent to the front end 56*a* of the rib structure 54, the front wall 55 generally projecting away from the bottom surface 53 of the sill strip 50 (along the Z-axis). The rib structure 54 is shown as having a front end 56*a*, a back end 56*b*, side walls 56*c* and 56*d* and a top wall 56*e*. In one embodiment, the front end 56*a* is flush against the front wall 55 to form a continuous surface. The side walls 56*c* and 56*d* generally extend upward and away from the bottom surface 53 of the sill strip 50 (along the Z-axis). The spacing of the rib structures 54 may vary and/or be substantially identical from rib structure 54 to rib structure 54 along the length of the sill strip 50. In one particular embodiment, the spacing between each of the rib structures 54 may be about 1.5 inches or about 2 inches or about 2.5 inches or about 3 inches or about 3.5 inches or about 4 inches. In another embodiment, the spacing between each of the rib structures 54 may be between about 1 inch to about 2 inches.

Figure 7B:
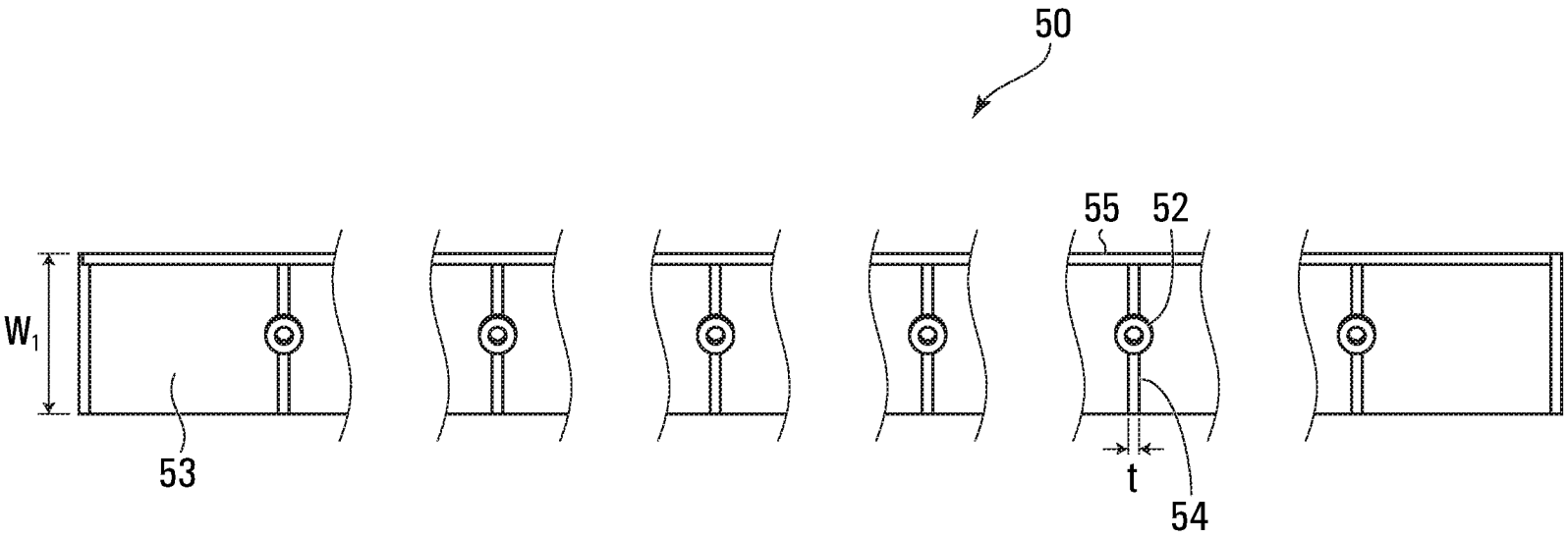
FIG. 7B is a bottom broken view of the rib structures and sill strip that is a component of the window pan drainage system of FIG. 5.
Figure 7C:
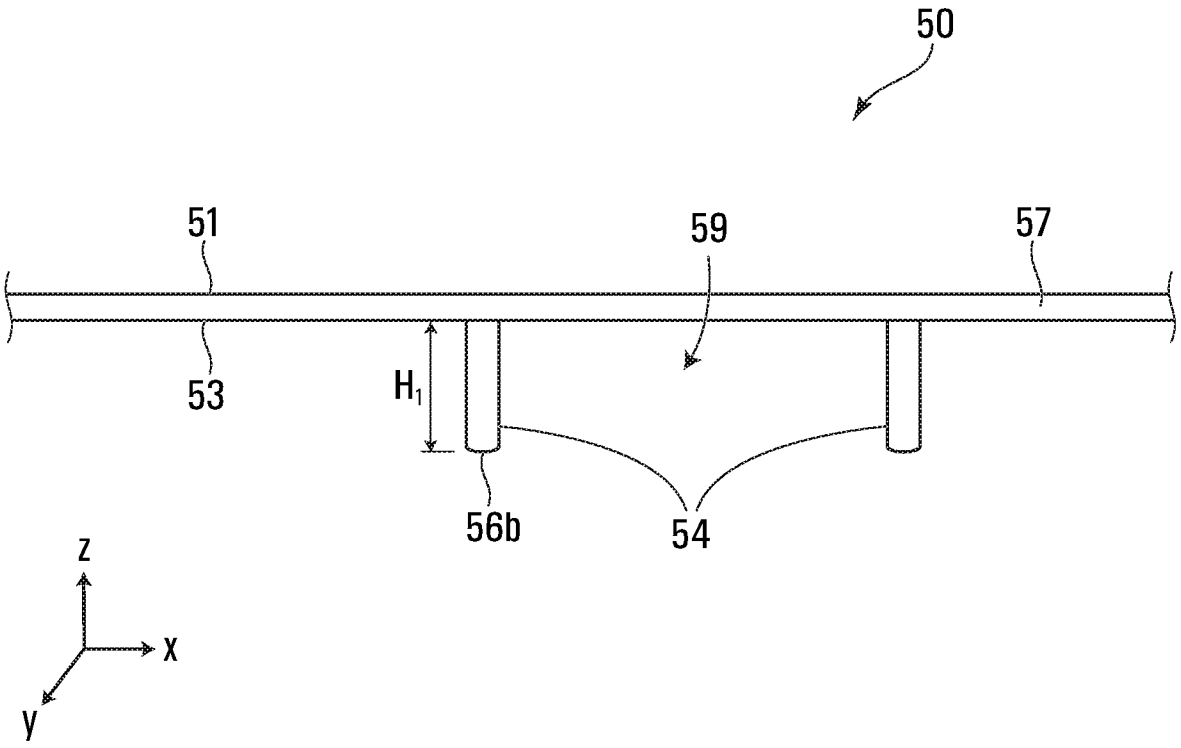
FIG. 7C is an enlarged back view of the rib structure of the sill strip that is a component of the window pan drainage system of FIG. 5.
Figure 8A:
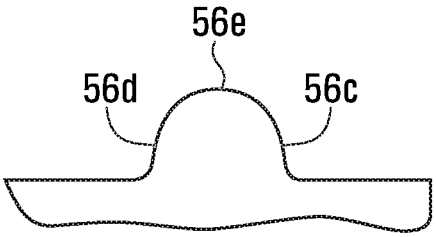
FIGS. 8A-8G are views of examples of rib structures herein.
Figure 8B:
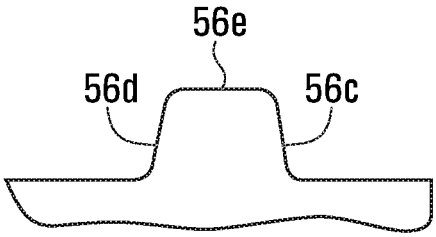
Figure 8C:
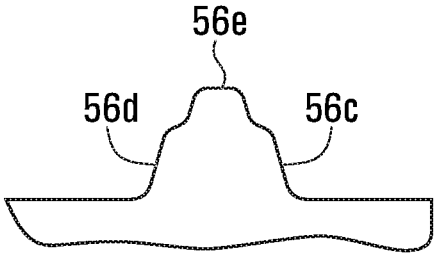
Figure 8D:
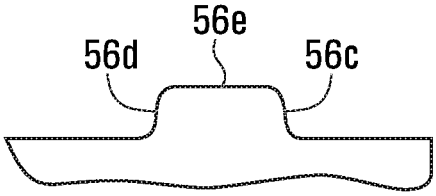
Figure 8E:
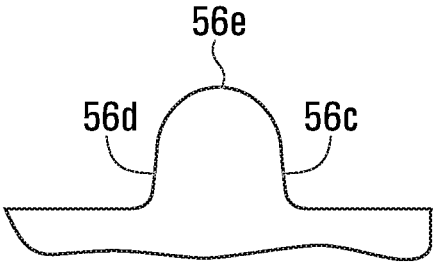
Figure 8F:
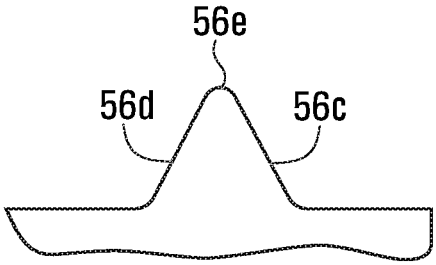
Figure 8G:
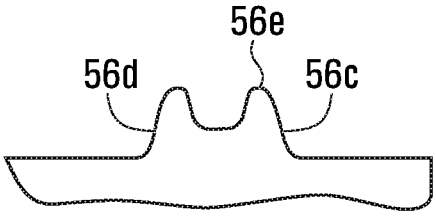

With reference to FIG. 7C, the spacing between the rib structures 54 creates a plurality of cavities 59 between the bottom surface 53 of the sill strip 50 and the side walls of adjacent rib structures 54 and the sill surface 37 of window sill 28 (when installed in window sill 28). The cavities 59 are configured to allow insulation to be inserted therein to improve the insulation factor for the window pan drainage system 40. It has been surprisingly found that such improvement allows the window pan drainage system 40 to achieve up to a R23 insulation rating.

With reference to FIGS. 7A and 7C, as noted above, the height of the rib structure 54 from the surface 56*e* of the rib structure 54 to the bottom surface 53 of the sill strip 50 is tapered from the back end 56*b* to the front end 56*a*. According to one embodiment, the ratio of the height $H_1$ of the back end 56*b* to the height $H_2$ of the front end 56*a* may range from about 1.1/1 to about 6/1 or from about 1.5/1 to about 5/1 or from about 2/1 to about 4/1 or from about 2.5/1 to about 3.5/1. In one particular embodiment, the height $H_1$ of the back end 56*a* may range from about 0.20 inches to about 0.5 inches or from about 0.25 inches to about 0.45 inches or from about 0.30 inches to about 0.4 inches. In another embodiment, the height $H_2$ of the front end 56*a* may range from about 0.05 inches to about 0.2 inches or from about 0.075 inches to about 0.175 inches or from about 0.1 inches to about 0.15 inches.

Also shown in FIG. 7C is a back wall 57 of sill strip 50 adjacent to the back end 56*b* of the rib structure 54, the back wall 57 generally projecting away from the bottom surface 53 of the sill strip 50 (along the Z-axis). In one embodiment, the back end 56*b* of rib structure 54 is flush against the back wall 55 of sill strip 50 to form a continuous surface.

With reference to FIG. 7B, the width t (along the X-axis) of the rib structures 54 may be the same for each rib structure 54 or it may vary from rib structure 54 to rib structure 54. In other embodiments, the width t of the rib structure may be tapered from the front end 56*a* to the back end 56*b* or vice versa. According to one embodiment, the width t of the rib structure 54 is substantially identical along the length (Y-axis) from the front end 56*a* to the back end 56*b*. In one particular embodiment, the width t of the rib structure 54 is substantially identical along the length from the front end 56*a* to the back end 56*b* and can be from about 0.02 inches to about 0.12 inches or from about 0.03 inches to about 0.11 inches or from about 0.04 inches to about 0.10 inches or from about 0.05 inches to about 0.95 inches.

Also shown in FIG. 7B, in one embodiment fastener locator or aperture 52 is positioned along the length of the rib structure 54. One or more rib structures 54 may comprise such an aperture 52. According to one embodiment, aperture 52 is positioned at about ½ the length between front end 56*a* and back end 56*b* while in other embodiments, aperture 52 may be positioned along the length of the rib structure 54 such that it is closer to the front end 56*a* or closer to the back end 56*b*.

The number of rib structures 54 per sill strip 50 may vary depending on the length of the sill strip 50. Thus, in one embodiment, the number of rib structures may range from about 3 to about 15 or from about 4 to about 12 or from about 5 to about 10 or from about 6 to about 8 per sill strip. In another embodiment, the number of rib structures per sill strap may be at least 4 or at least 5 or at least 6 while in other embodiments the number of rib structures 54 per sill strip may be less than 11 or less than about 10 or less than about 9.

FIGS. 8A-8G illustrate examples of plan views or lateral cross-sectional views of alternative rib structure configurations. The rib structures 54 may have an arcuate surface 56*e* (e.g. embodiments 8A, 8E, 8F), a substantially flat surface 56*e* (e.g. embodiments 8B, 8C, 8D), one or more steps along at least one side wall 56*c* and 56*d* (e.g. embodiment 8C), curved side walls 56*c* and 56*d* (e.g. embodiments 8A and 8D), substantially straight side walls 56*c* and 56*d* (e.g. embodiments 8B, 8C, 8E, 8F, 8G), one or more undulations in the surface 56*e* (e.g. embodiment 8G) or any combination thereof.

With reference to FIGS. 6A and 6B, as noted above, sill strip 50 also includes one or more fastener locators or apertures 52. The fastener locator(s) or aperture(s) are configured to receive a mechanical fastener to anchor the sill strip to the window sill 28. In one embodiment, the mechanical fastener may be a nail, nut, bolt, screw, staple, pin, rivet or any combination thereof. In some embodiments, an adhesive may be used in conjunction with a fastener while in other embodiments, such adhesive may be used alone (and thus, no apertures would be needed). The apertures may located anywhere along the length (X-axis) of the sill strip 50. As described above, in one embodiment at least one aperture 52 is positioned on the sill strip 50 such that it lines up with a rib structure 54. The spacing between each aperture 52 may be substantially identical or it may vary from aperture 52 to aperture 52. The number of apertures 52 per sill strip 50 may vary and in some embodiments may be from about 2 to about 20 or from about 3 to about 15 or from about 4 to 10 or from about 5 to 8 per sill strip 50.

Figure 6C:
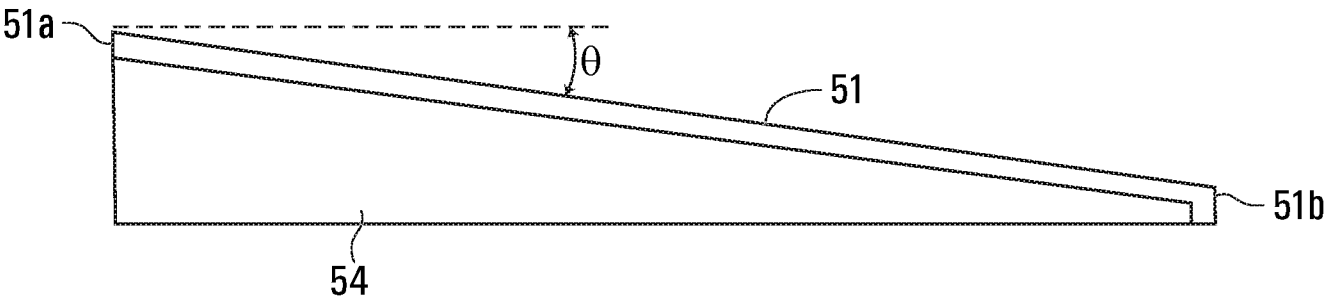
FIG. 6C is a side elevation cross-sectional view of the sill strip that is a component of the window pan drainage system of FIG. 5.

With reference to FIGS. 6A and 6C, the sill strip 50 has a top surface 51 that slopes slightly downward from the back 51*a* to the front 51*b* to employ gravity to encourage flow of liquid that ends up in the region above the top surface 51, as well as on the top surface 51, away from the interior-facing window side toward the exterior-facing window side. To cause the top surface 51 to be downwardly sloped when installed in window sill 28, the plurality of rib structures 54 extend downwardly a respective distance imparting an angle θ of downward slope to the top surface 51 that achieves a downward slope of less than about 10° or less than about 7.5° or less than about 5° or less than about 2.5°. In other embodiments, the plurality of rib structures 54 extend downwardly a respective distance imparting an angle θ of downward slope to the top surface 51 that achieves a downward slope of at least about 1/32 of an inch, or at least about 1/24 of an inch, or at least about 1/16 of an inch, or at least about 1/12 of an inch, or even at least about 1/8 of an inch. In other embodiments, the plurality of rib structures 54 extend downwardly a respective distance imparting an angle θ of downward slope to the top surface 51 that achieves a downward slope of between about 1/32 of an inch and 1/4 of an inch, or between about 1/24 of an inch and 1/6 of an inch, or between about 1/20 of an inch and 1/8 of an inch or even between about 1/16 of an inch and 1/12 of an inch.

According to one embodiment, the sill strip 50 has a relatively thin cross-sectional thickness. When made of plastic, this imparts a desired amount of flexibility enabling it to better conform to the contour variations of window sill 28 both along the length and width directions. This flexible construction helps optimize the sill strip 50 to fit a particular window sill 28 and oppose air and water infiltration by minimizing the likelihood of any gaps being formed. In one embodiment, the sill strip 50 has a cross-sectional thickness no greater than 1/8 of an inch. In another embodiment, the cross-sectional thickness of the sill strip 50 at the back end 51*a* is about 1/8 of an inch and the cross-sectional thickness of the sill strip 50 at the front end 51*b* is about 1/16 of an inch.

In one embodiment, the sill strip 50 may have a length (along the X-axis) between about 10 inches to about 40 inches. In one particular embodiment, the sill strip may have length of about 10 inches or about 20 inches or about 30 inches or about 40 inches. The sill strip 50 may also have a width (along the Y-axis) of less than about 2 inches or less than about 1.9 inches or less than about 1.8 inches or less than about 1.7 inches.

With reference to FIGS. 10A, 10B, 10C and 10D, according to one embodiment the right corner dam 60 is of generally L-shaped construction having a lower top surface 61*a* and upper top surface 61*b*, at least one fastener locator or aperture 62, a lower bottom surface 63*a* comprising a plurality of rib structures 64 spaced apart from each other and an upper bottom surface 63*b* comprising a plurality of rib structures 64 spaced apart from each other, the rib structures 64 configured to support the right corner dam 60. Only a detailed construction of right corner dam 60 will be described herein, it being understood that the left corner dam 70 may be constructed in a substantially identical manner as a mirror image of the right corner dam 60.

The lower and upper top surfaces 61*a* and 61*b* of the right corner dam 60 may be configured for draining water or moisture away from the interior side 33 to the exterior side 35 when installed in window frame 20 as shown in FIG. 9. Thus, the lower top surface 61*a* may be continuously sloped relative to a horizontal plane defined by the length and width directions (X- and Y-axis) and the upper top surface 61*b* may be continuously sloped relative to a vertical plane defined by the height and width directions (Y- and Z-axis). To provide the lower and upper top surfaces 61*a* and 61*b* with the desired slope, the lower bottom surface 63*a* may have a plurality of rib structures 64 extending downward from the lower bottom surface 63*a* (along the Y-axis) and the upper bottom surface 63*b* may have a plurality of rib structures 64 extending downward from the upper bottom surface 63*b* (along the X-axis). The height of the rib structure 64 on the lower bottom surface 63*a* is tapered toward the exterior side 40 of window sill 28 along the width direction (Y-axis) and the height of the rib structure 64 on the upper bottom surface 63*b* is tapered toward the exterior side along the length direction (X-axis). Therefore, when the rib structures 64 rest on a substantially horizontal window sill 28, both the lower and upper top surfaces 61*a* and 61*b* are oriented with a slope (downward) toward the exterior side 40 of the window sill 28.

With continued reference to FIGS. 10A, 10B, 10C, and 10D, the rib structures 64 are positioned along substantially all of the width direction (Y-axis) of the lower and upper bottom surfaces 63*a*, 63*b* of the right corner dam 60. Also shown is a lower front wall 65*a*, the front wall 65*a* generally projecting away from the lower bottom surface 63*a* of the right corner dam 60 (along the Z-axis). Additionally shown is an upper front wall 65*b*, the upper front wall 65*b* generally projecting away from the upper bottom surface 63*b* of the right corner dam 60 (along the X-axis).

Figure 11A:
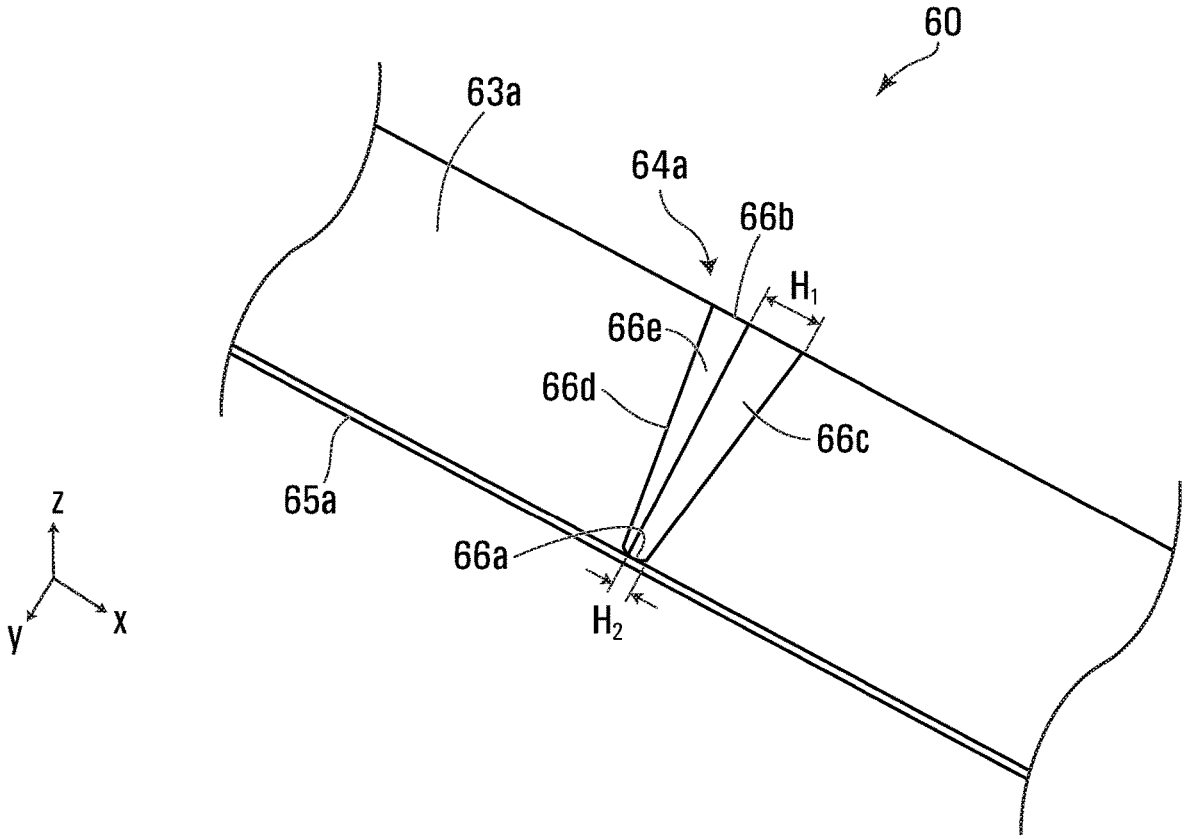
FIG. 11A is an enlarged perspective view of the rib structure on the lower bottom surface of the right corner dam that is a component of the window pan drainage system of FIG. 5.

With reference to FIG. 11A, the rib structure 64*a* along lower bottom surface 63*a* is shown as having a front end 66*a*, a back end 66*b*, side walls 66*c* and 66*d* and a top surface 66*e*. In one embodiment, the front end 66*a* is flush against the front wall 65*a* to form a continuous surface. The side walls 66*c* and 66*d* generally extend upward and away from the lower bottom surface 63*a* of the right corner dam 60 (along the Z-axis). The spacing of the rib structures 64*a* may vary and/or be substantially identical from rib structure 64*a* to rib structure 64 along the length of the right corner dam 60. In one embodiment, the spacing between the rib structures 64*a* may be between about 0.5 inches to about 2 inches. The spacing between the rib structures 64*a* creates a cavity 69*a* between the lower bottom surface 63*a* of the right corner dam 60 and the side walls of adjacent rib structures 64*a* and the sill surface 37 of window sill 28 (when installed in window sill 28). The cavity 69*a* is configured to allow insulation to be inserted therein to improve the insulation factor for the window pan drainage system 40 as described above and allow the window pan drainage system to achieve up to a R23 insulation rating.

The height of the rib structure 64*a* from the top surface 66*e* of the rib structure 64*a* to the lower bottom surface 63*a* of the right corner dam 60 is tapered from the back end 66*b* to the front end 66*a*. According to one embodiment, the ratio of the height $H_1$ of the back end 66*b* to the height $H_2$ of the front end 66*a* may range from about 1.1/1 to about 8/1 or from about 1.5/1 to about 6/1 or from about 2/1 to about 4/1. In one particular embodiment, the height $H_1$ of the back end 66*b* may range from about 0.10 inches to about 0.5 inches or from about 0.125 inches to about 0.45 inches or from about 0.15 inches to about 0.4 inches. In another embodiment, the height $H_2$ of the front end 66*a* may range from about 0.025 inches to about 0.2 inches or from about 0.03 inches to about 0.175 inches or from about 0.035 inches to about 0.15 inches.

Figure 10A:
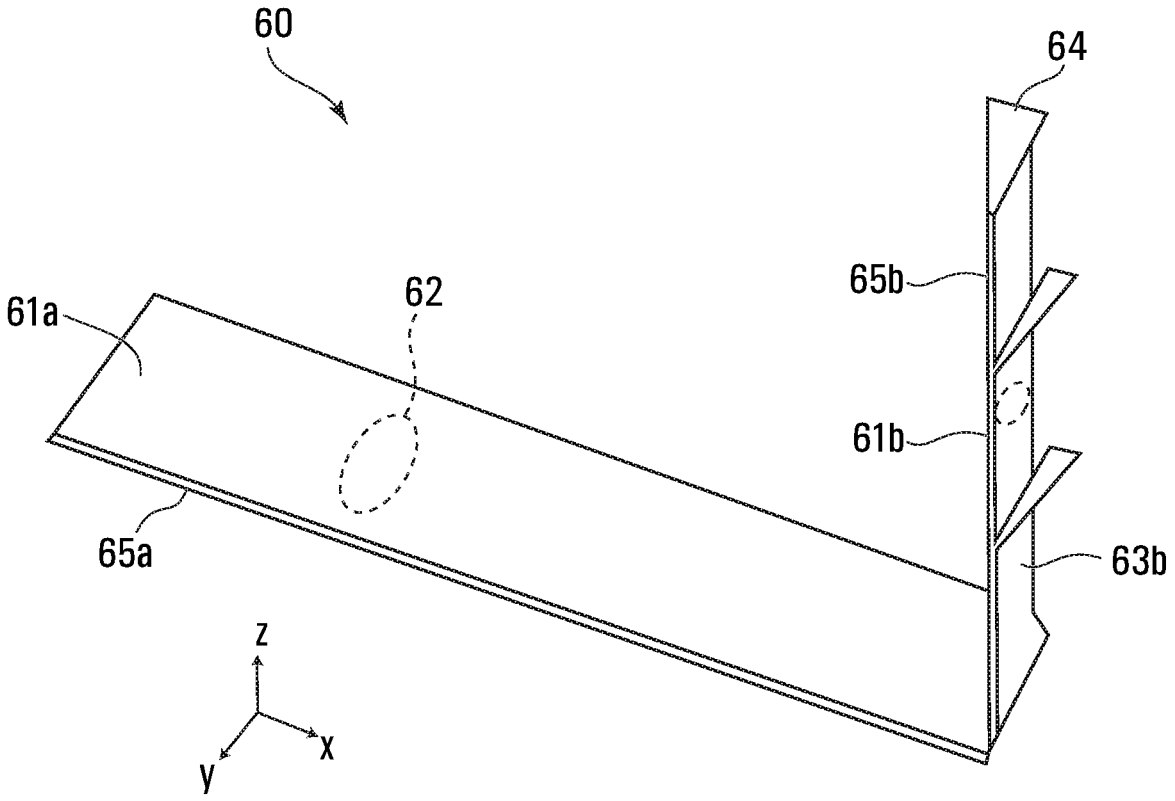
FIG. 10A is a front perspective view of a right corner dam that is a component of the window pan drainage system of FIG. 5.
Figure 10B:
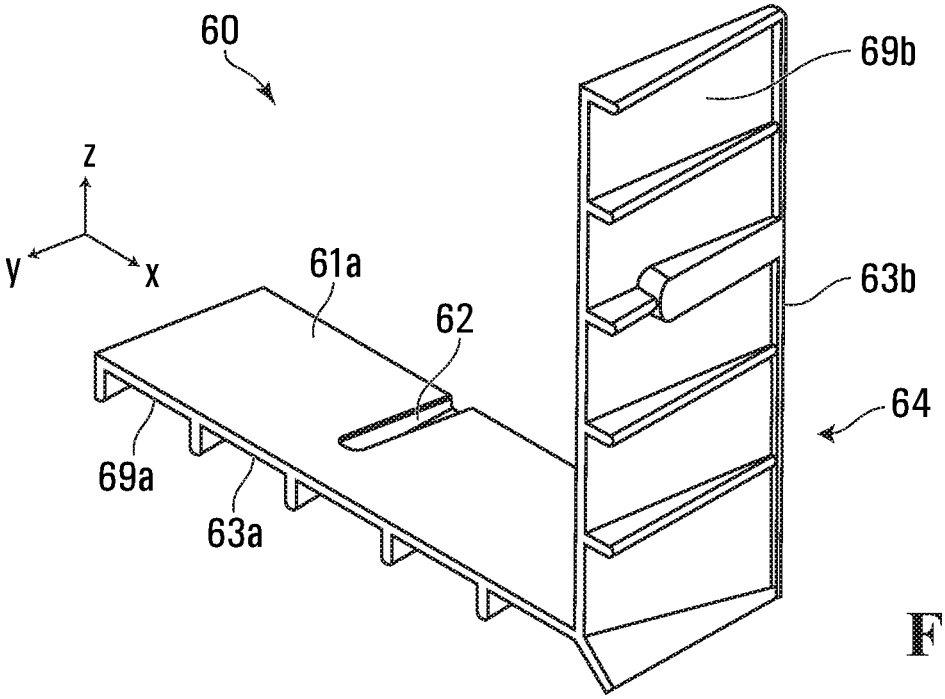
FIG. 10B is a back perspective view of the right corner dam that is a component of the window pan drainage system of FIG. 5.
Figure 10C:
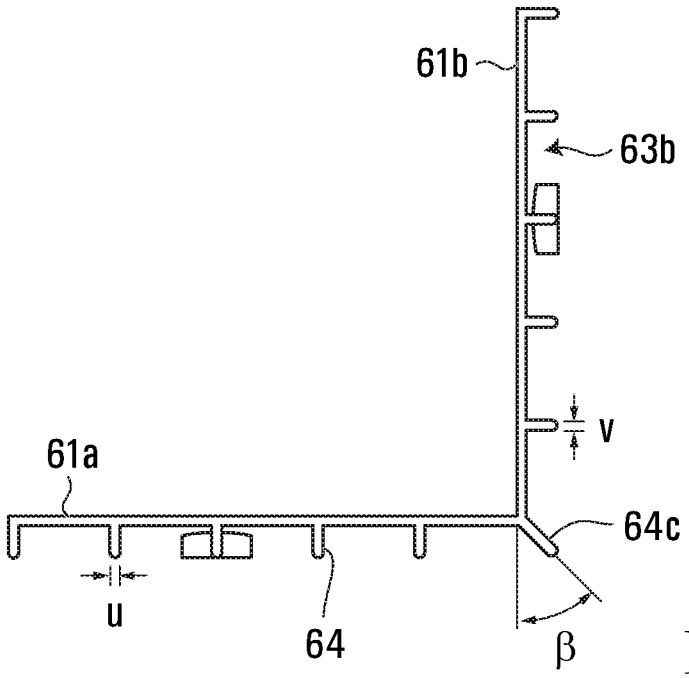
FIG. 10C is a back view of the right corner dam that is a component of the window pan drainage system of FIG. 5.
Figure 10D:
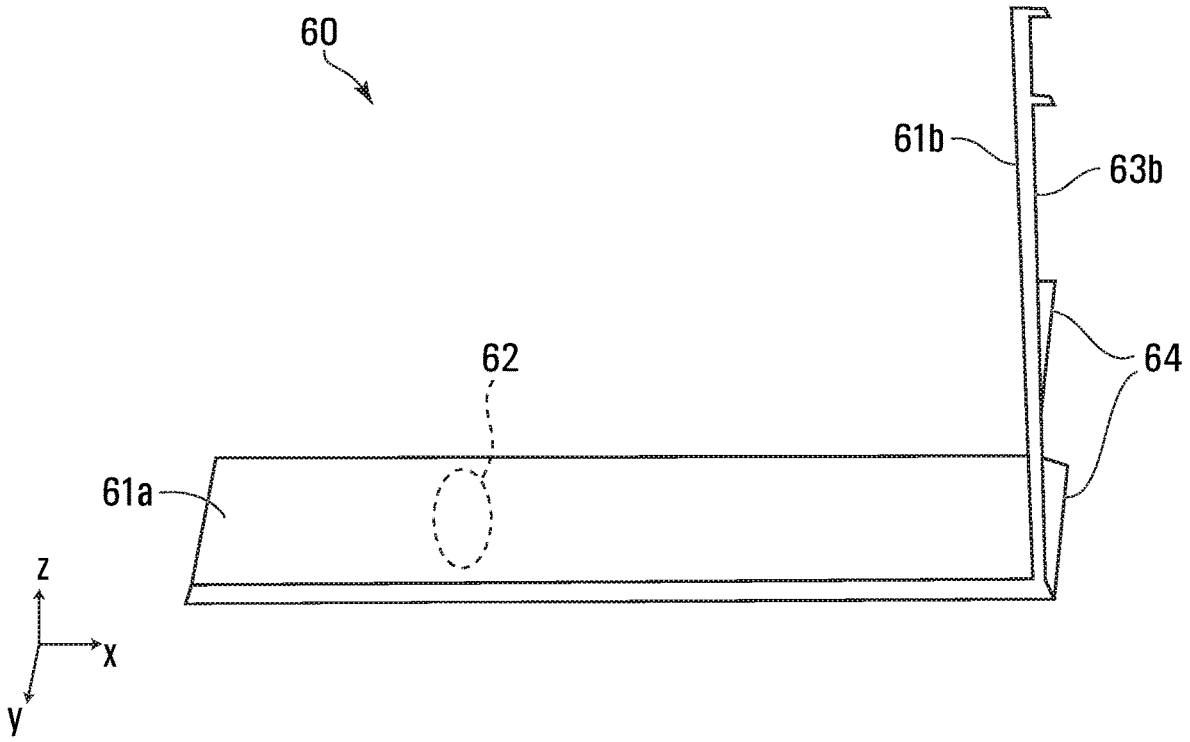
FIG. 10D is a front view of the right corner dam that is a component of the window pan drainage system of FIG. 5.

With reference to FIGS. 10C and 11A, the width u (along the X-axis) of the rib structures 64*a* may be the same for each rib structure 64*a* or it may vary from rib structure 64*a* to rib structure 64*a*. In other embodiments, the width u of the rib structure 64*a* may be tapered from the front end 66*a* to the back end 66*b* or vice versa. According to one embodiment, the width u of the rib structure 64*a* is substantially identical along the length (Y-axis) from the front end 66*a* to the back end 66*b*. In one particular embodiment, the width u of the rib structure 64*a* is substantially identical along the length from the front end 66*a* to the back end 66*b* and can be from about 0.02 inches to about 0.12 inches or from about 0.03 inches to about 0.11 inches or from about 0.04 inches to about 0.10 inches or from about 0.05 inches to about 0.095 inches.

Figure 11B:
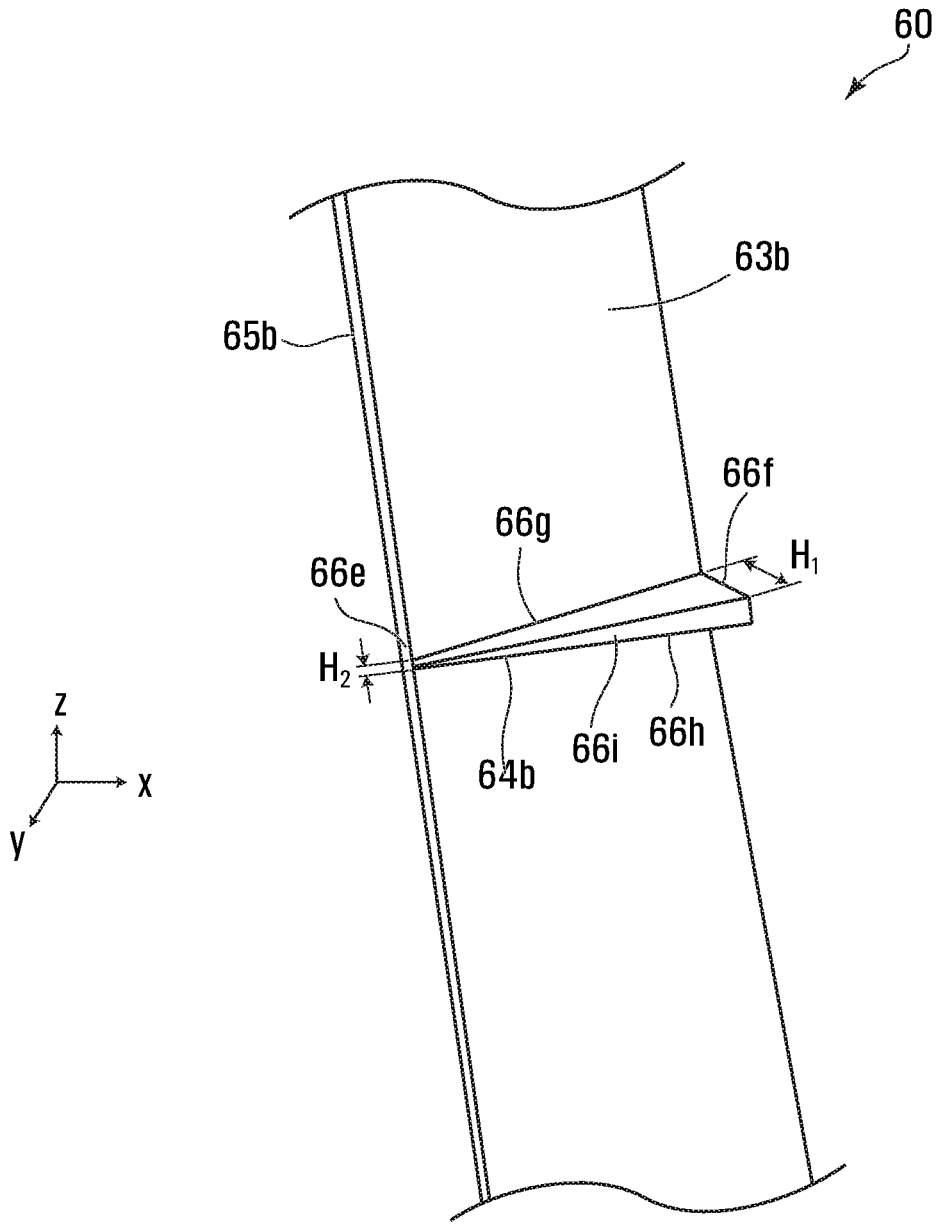
FIG. 11B is an enlarged perspective view of the rib structure on the upper bottom surface of the right corner dam that is a component of the window pan drainage system of FIG. 5.

With reference to FIG. 11B, the rib structure 64*b* along upper bottom surface 63*b* is shown as having a front end 66*e*, a back end 66*f*, side walls 66*g* and 66*h* and a top surface 66*i*. In one embodiment, the front end 66*e* is flush against the front wall 65*b* to form a continuous surface. The side walls 66*g* and 66*h* generally extend upward and away from the lower bottom surface 63*b* of the right corner dam 60 (along the X-axis). The spacing of the rib structures 64*b* may vary and/or be substantially identical from rib structure 64*b* to rib structure 64*b* along the height of the right corner dam 60. In one embodiment, the spacing between the rib structures 64*b* may be between about 0.5 inches to about 2 inches. The spacing between the rib structures 64*b* creates a cavity 69*b* between the upper bottom surface 63*b* of the right corner dam 60 and the side walls of adjacent rib structures 64*b* and the top surface the side portion 26 (when installed in window sill 28). The cavity 69*b* is configured to allow insulation to be inserted therein to improve the insulation factor for the window pan drainage system 40 to improve the insulation factor for the window pan drainage system 40 as described above and allow the window pan drainage system to achieve up to a R23 insulation rating.

The height of the rib structure 64*b* from the top surface 66*i* of the rib structure 64*b* to the lower bottom surface 63*b* of the right corner dam 60 is tapered from the back end 66*f* to the front end 66*e*. According to one embodiment, the ratio of the height $H_1$ of the back end 66*f* to the height $H_2$ of the front end 66*e* may range from about 1.1/1 to about 8/1 or from about 1.5/1 to about 6/1 or from about 2/1 to about 4/1. In one particular embodiment, the height $H_1$ of the back end 66*f* may range from about 0.10 inches to about 0.5 inches or from about 0.125 inches to about 0.45 inches or from about 0.15 inches to about 0.4 inches. In another embodiment, the height $H_2$ of the front end 66*e* may range from about 0.025 inches to about 0.2 inches or from about 0.05 inches to about 0.175 inches or from about 0.0625 inches to about 0.15 inches.

With reference to FIGS. 10C and 11B, the width v (along the Z-axis) of the rib structures 64*b* may be the same for each rib structure 64*b* or it may vary from rib structure 64*b* to rib structure 64*b*. In other embodiments, the width v of the rib structure 64*b* may be tapered from the front end 66*e* to the back end 66*f* or vice versa. According to one embodiment, the width v of the rib structure 64*b* is substantially identical along the length (Z-axis) from the front end 66*e* to the back end 66*f*. In one particular embodiment, the width v of the rib structure 64*b* is substantially identical along the length from the front end 66*e* to the back end 66*f* and can be from about 0.02 inches to about 0.12 inches or from about 0.03 inches to about 0.11 inches or from about 0.04 inches to about 0.10 inches or from about 0.05 inches to about 0.95 inches.

The number of rib structures 64 per right corner dam may vary depending on the length and height of the right corner dam 60. Thus, in one embodiment, the number of rib structures 64 may range from about 3 to about 15 or from about 4 to about 12 or from about 5 to about 10 or from about 6 to about 8 per right corner dam. In another embodiment, the number of rib structures 64 per right corner dam 60 may be at least 4 or at least 5 or at least 6 while in other embodiments the number of rib structures 64 per right corner dam may be less than 12 or less than about 11 or less 10 or less than about 9. Rib structure 64 may also have any configuration, such as those shown in FIGS. 8A-8G.

Figure 11C:
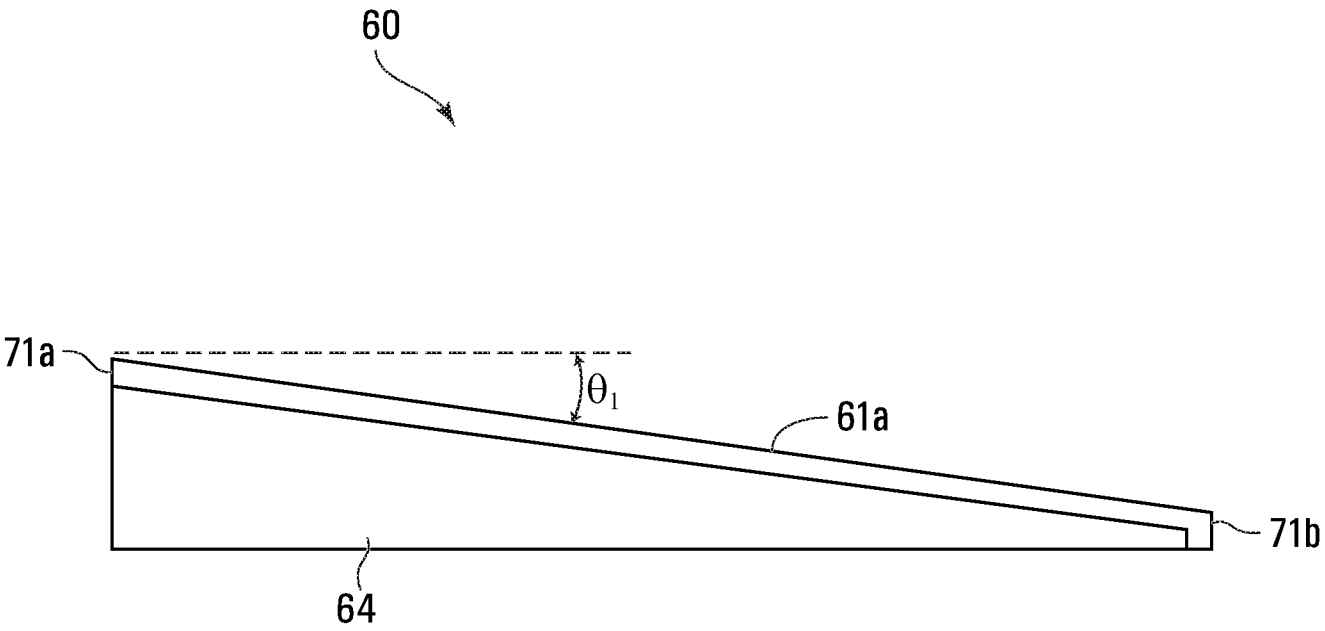
FIG. 11C is a side elevation cross-sectional view of the right corner dam that is a component of the window pan drainage system of FIG. 5.

With reference to FIG. 11C the right corner dam 60 has a lower top surface 61*a* that slopes slightly downward from the back 71*a* to the front 71*b* to employ gravity to encourage flow of liquid that ends up in the region above the lower top surface 61*a*, as well as on the lower top surface 61, away from the interior-facing window side toward the exterior-facing window side. To cause the lower top surface 61*a* to be downwardly sloped when installed in window sill 28, the plurality of rib structures 64 extend downwardly a respective distance imparting an angle $\theta_1$ of downward slope to the top surface 61*a* that achieves a downward slope of less than about 10° or less than about 7.5° or less than about 5° or less than about 2.5°. In other embodiments, the plurality of rib structures 64 extend downwardly a respective distance imparting an angle $\theta_1$ of downward slope to the top surface 61*a* that achieves a downward slope of at least about 1/32 of an inch, or at least about 1/24 of an inch, or at least about 1/16 of an inch, or at least about 1/12 of an inch, or even at least about 1/8 of an inch. In other embodiments, the plurality of rib structures 64 extend downwardly a respective distance imparting an angle $\theta_1$ of downward slope to the top surface 61*a* that achieves a downward slope of between about 1/32 of an inch and 1/4 of an inch, or between about 1/24 of an inch and 1/6 of an inch, or between about 1/20 of an inch and 1/8 of an inch or even between about 1/16 of an inch and 1/12 of an inch.

Figure 11D:
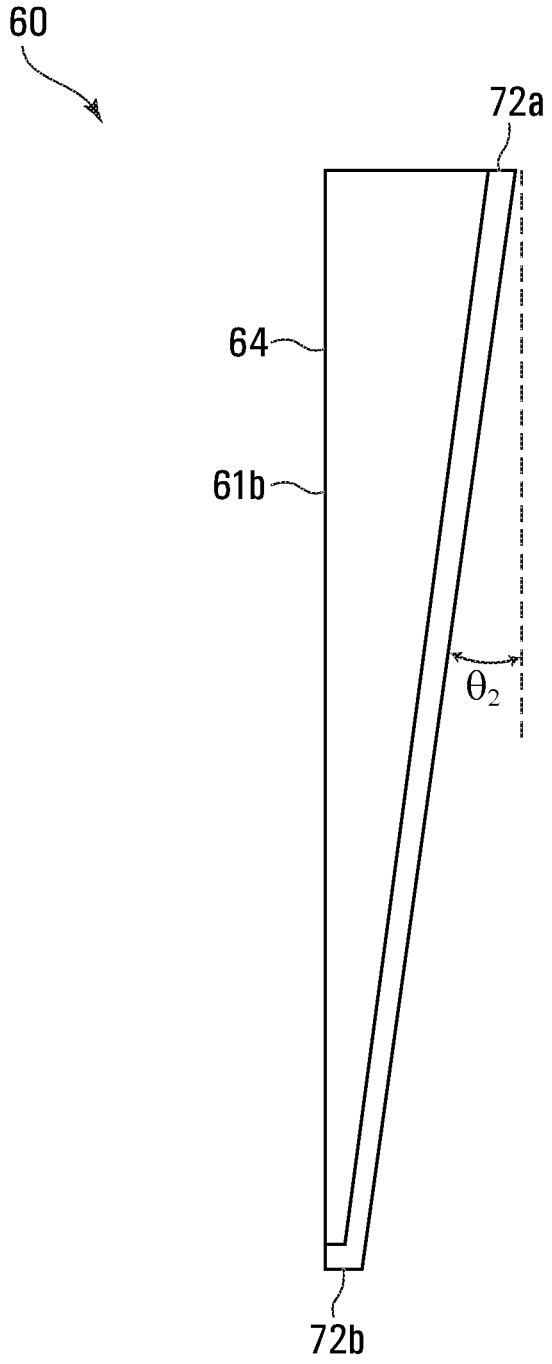
FIG. 11D is a top elevation cross-sectional view of the right corner dam that is a component of the window pan drainage system of FIG. 5.

With reference to FIG. 11D, the right corner dam 60 has an upper top surface 61*b* that slopes slightly downward from the back 72*a* to the front 72*b* to employ gravity to encourage flow of liquid that ends up in the region above the upper top surface 61*b*, as well as on the lower top surface 61*b*, away from the interior-facing window side toward the exterior-facing window side. To cause the upper top surface 61*b* to be downwardly sloped when installed in window sill 28, the plurality of rib structures 64 extend downwardly a respective distance imparting an angle $\theta_2$ of downward slope to the top surface 61*b* that achieves a downward slope of less than about 10° or less than about 7.5° or less than about 5° or less than about 2.5°. In other embodiments, the plurality of rib structures 64 extend downwardly a respective distance imparting an angle $\theta_2$ of downward slope to the top surface 61*a* that achieves a downward slope of at least about 1/32 of an inch, or at least about 1/24 of an inch, or at least about 1/16 of an inch, or at least about 1/12 of an inch, or even at least about 1/8 of an inch. In other embodiments, the plurality of rib structures 64 extend downwardly a respective distance imparting an angle $\theta_2$ of downward slope to the top surface 61*a* that achieves a downward slope of between about 1/32 of an inch and 1/4 of an inch, or between about 1/24 of an inch and 1/6 of an inch, or between about 1/20 of an inch and 1/8 of an inch or even between about 1/16 of an inch and 1/12 of an inch.

According to one embodiment, the right corner dam 60 has a relatively thin cross-sectional thickness. When made of plastic, this imparts a desired amount of flexibility enabling it to better conform to the contour variations of window sill 28 both along the length and width directions and the side portion 26 both along the height and width directions. This flexible construction helps optimize the right corner dam 60 to fit a particular window sill 28 and oppose air and water infiltration by minimizing the likelihood of any gaps being formed. In one embodiment, the right corner dam 60 has a cross-sectional thickness no greater than 1/8 of an inch. In another embodiment, the cross-sectional thickness of the right corner dam 60 at the back ends 71*a* and 72*a* is about ⅛ of an inch and the cross-sectional thickness of the right corner dam 60 at the front ends 71*b* and 72*b* is about 1/16 of an inch.

In one embodiment, the right corner dam 60 may have a length (along the X-axis) from about 2 inches to about 30 inches and a height (along the Z-axis) from about 2 inches to about 8 inches. In one particular embodiment, the right corner dam may have length of about 2 inches or about 3 inches or about 4 inches or about 5 inches or about 6 inches or about 10 inches or about 20 inches or about 30 inches. In another embodiment, the right corner dam 60 may have height of about 2 inches or about 3 inches or about 4 inches or about 5 inches or about 6 inches. The right corner dam 60 may also have a width (along the Y-axis) of less than about 2 inches or less than about 1.9 inches or less than about 1.8 inches or less than about 1.7 inches.

Figure 12C:
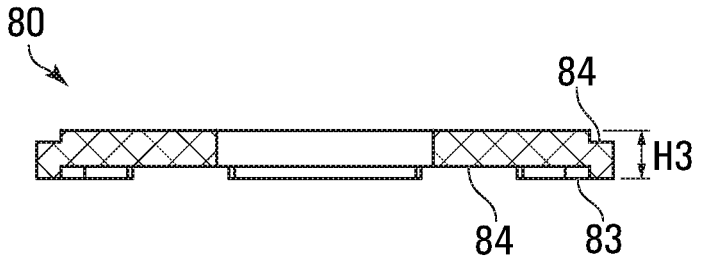
FIGS. 12A, 12B and 12C are top and side views of a shim that is a component of the window pan drainage system of FIG. 5.
Figure 12A:
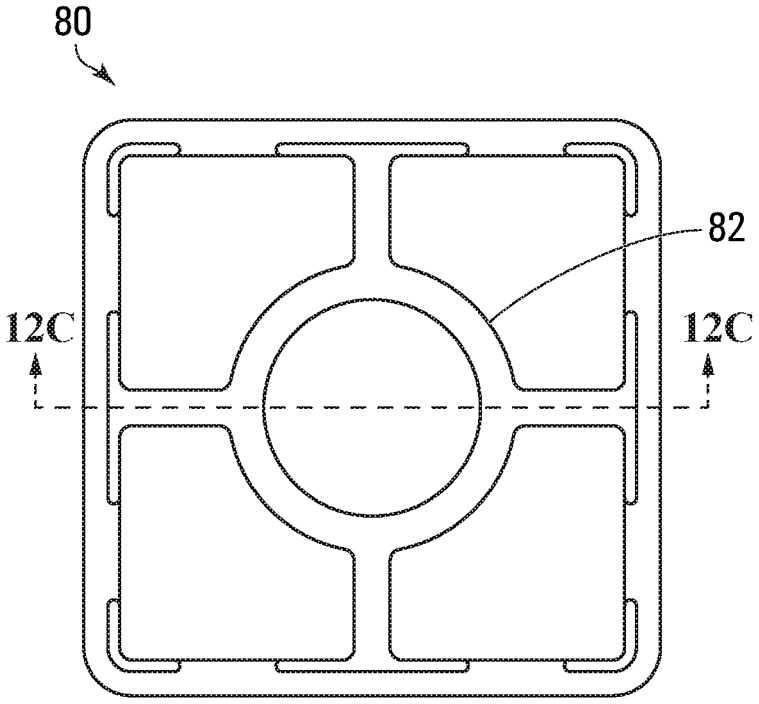
Figure 12B:
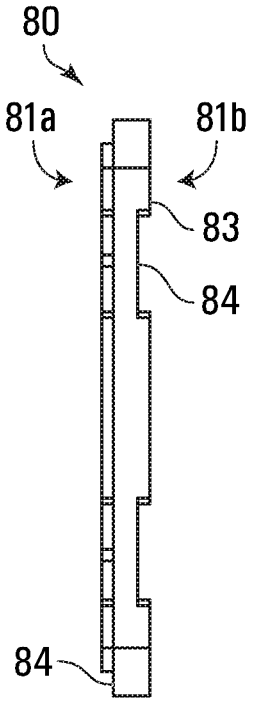

With reference to FIGS. 12A, 12B and 12C, the window pan drainage system 40 may also comprise one or more shims 80 to help level one or more of the various components of the window pan drainage system 40 when it is installed in the window sill 28. The shims 80 are of a generally hollow rectangular-shaped construction having a top surface 81*a*, a bottom surface 81*b*, and a support structure 82. The top surface 81*a* and bottom surface 81*b* have a plurality of ridges 83 and grooves 84 to allow two or more shims 80 to interconnect to one another depending on the desired amount of levelling needed, for example, such that the installed window or door is level. In one embodiment, the top surface 81*a* and bottom surface 81*b* have a plurality of ridges 83 and grooves 84 to allow two or more shims 80 to interconnect to one another to establish a minimum height of 0.375 inches. Thus, in one embodiment the shim may have a height $H_3$ of about 0.125 inches or in other embodiments the shim may have a height $H_3$ about 0.375 inches.

Figure 13:
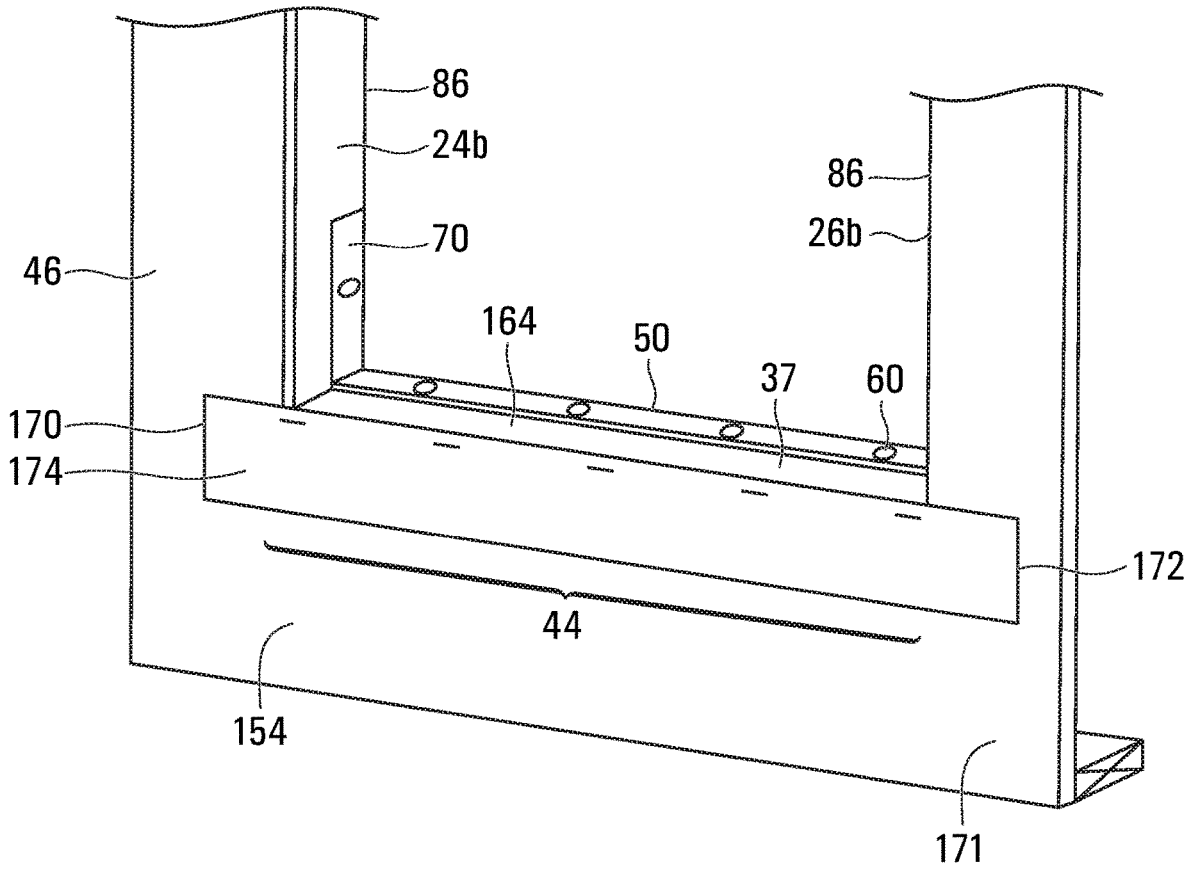
FIG. 13 is a perspective view of a window assembly in part.

FIGS. 9 and 13-17 illustrate at least one implementation of a method of installing a window pan drainage system 40 constructed in accordance with the present disclosure. In FIGS. 9 and 13, a window pan drainage system 40 is disposed on the window sill 28 adjacent to the interior end 39 such that a transverse elongate portion 64 of the top sill surface 37 and side portion surfaces 24*b* and 26*b* adjacent to the exterior end are temporarily uncovered or exposed. The sill strip 50 and right and left corner dams 60 and 70 are elongate and thus configured with a width 86 that is substantially similar to the sill width 44. One or more shims 80 (not shown) may optionally be placed between the bottom surfaces of the right and left corner dams 60 and 70 and sill strip 50 and the top sill surface 37 and/or side portion surfaces 24*b* and 26*b*. The right and left corner dams 60 and 70 and sill strip 50 may then be fastened to the top sill surface 37*a* and side portion surfaces 24*b* and 26*b*. Insulation may be then placed in the cavities 59 and 69 formed between the bottom surfaces of the right and left corner dams 60, 70 and the sill strip 50 and the sill surface 37 and side portion surfaces 24*b* and 26*b* prior to or after such fastening.

In FIG. 13, a thin flashing material 170 is coupled to the bottom portion 154 of the structural panel 146. The flashing 170 extends transversely beneath the sill surface 37 and traverses in some embodiments beyond the sill width 44. In one embodiment, the flashing 170 is coupled to an exterior surface 171 of the bottom board portion 154, in some embodiments at a top flashing section 172, such as with staples, thereby leaving a bottom flashing section 174 loose.

Figure 14:
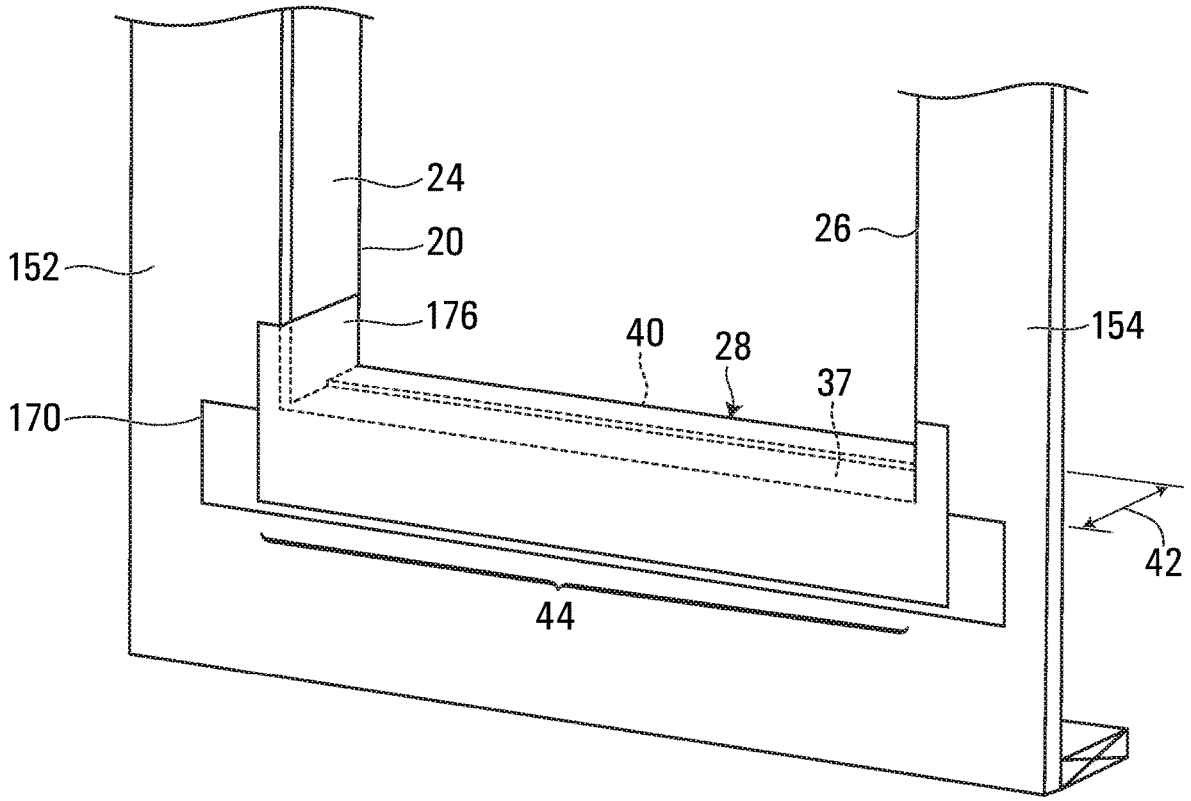
FIG. 14 is a perspective view of a window assembly in part, showing placement of a one-piece waterproof adhesive material.

In FIG. 14, a thin elastic adhesive material 176 may be disposed over the window pan drainage system 40 and the temporarily exposed portion 164 of the sill surfaces 37*a* and 37*b*. The elastic adhesive material 176 in one embodiment comprises a commonly known waterproof material, such as TYVEK® or Henry® Blue Skin, that is generally already being used in the construction of the building. The adhesive material 176 is preferably a unitary, one piece material configured with larger dimensions than that of the sill surface 37 and side portion surfaces 24*b* and 26*b*, namely, with a width greater than the sill width 44 and a length greater than the sill depth 42 such that the adhesive material 176 generously covers the sill surface 37 and side portion surfaces 24*b* and 26*b* and beyond. In particular, the adhesive material 176 covers bottom sections of the first jamb 152 and the second jamb 154, bottom sections of the side portions 24 and 26 of the frame 20 and the bottom flashing 170.

Figure 15:
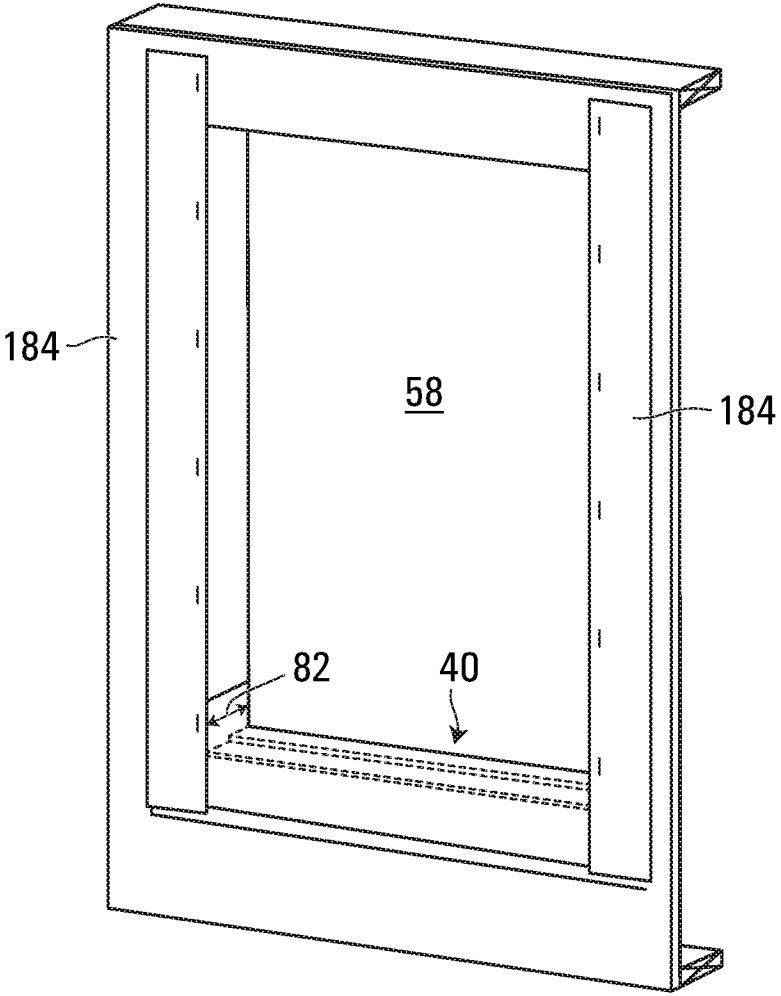
FIG. 15 is a perspective view of a window assembly in part, including vertical flashing materials.

With the application of the adhesive material 176 onto the window pan drainage system 40 and surrounding areas of the window sill 28 as shown in FIGS. 14 and 15, it will be appreciated that a one-piece watertight pan assembly, is formed over the window sill 28 with a slope 82 that directs any fluid thereon outwardly away from the interior or internal wall area keeping the wall assembly free of water ingress in the window (or door) opening or water penetration in the sill areas of the building.

Figure 16:
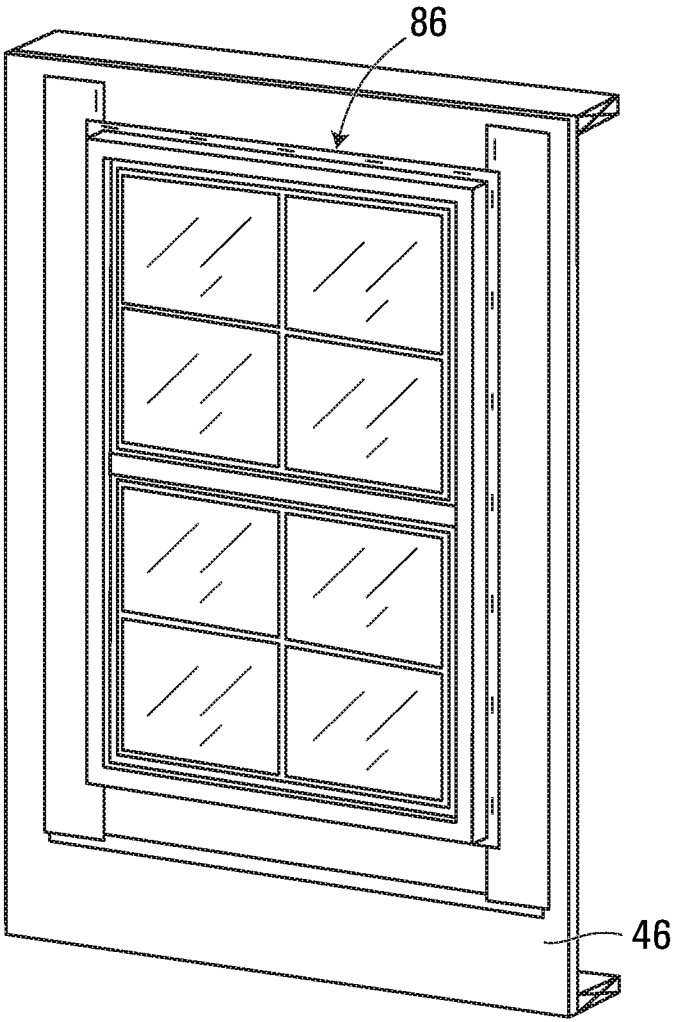
FIG. 16 is a perspective view of a window assembly in part, showing placement of a window.
Figure 17:
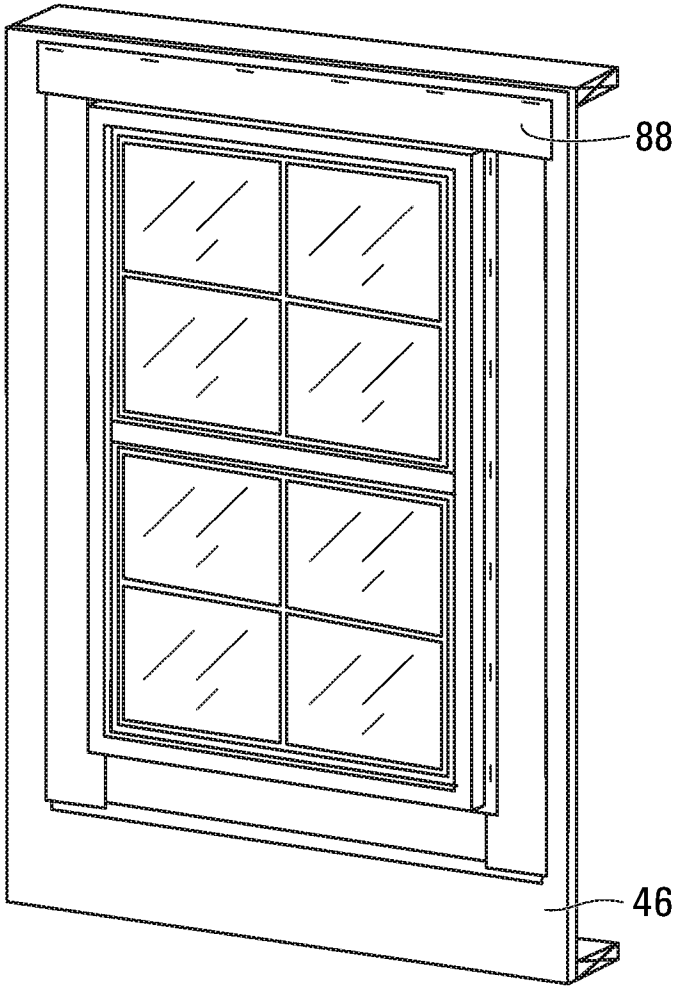
FIG. 17 is a perspective view of a window assembly, showing placement of a top flashing material.

Additional flashings 184 may be applied vertically on the first and second jambs 150 and 152 as shown in FIG. 15. In FIG. 16, a window 186 is installed onto the structural panel 146, the window 186 being aligned with the window opening 58 shown in FIG. 5. A head flashing 188 may be coupled to the structural panel 146 as shown in FIG. 17.

Figure 18:
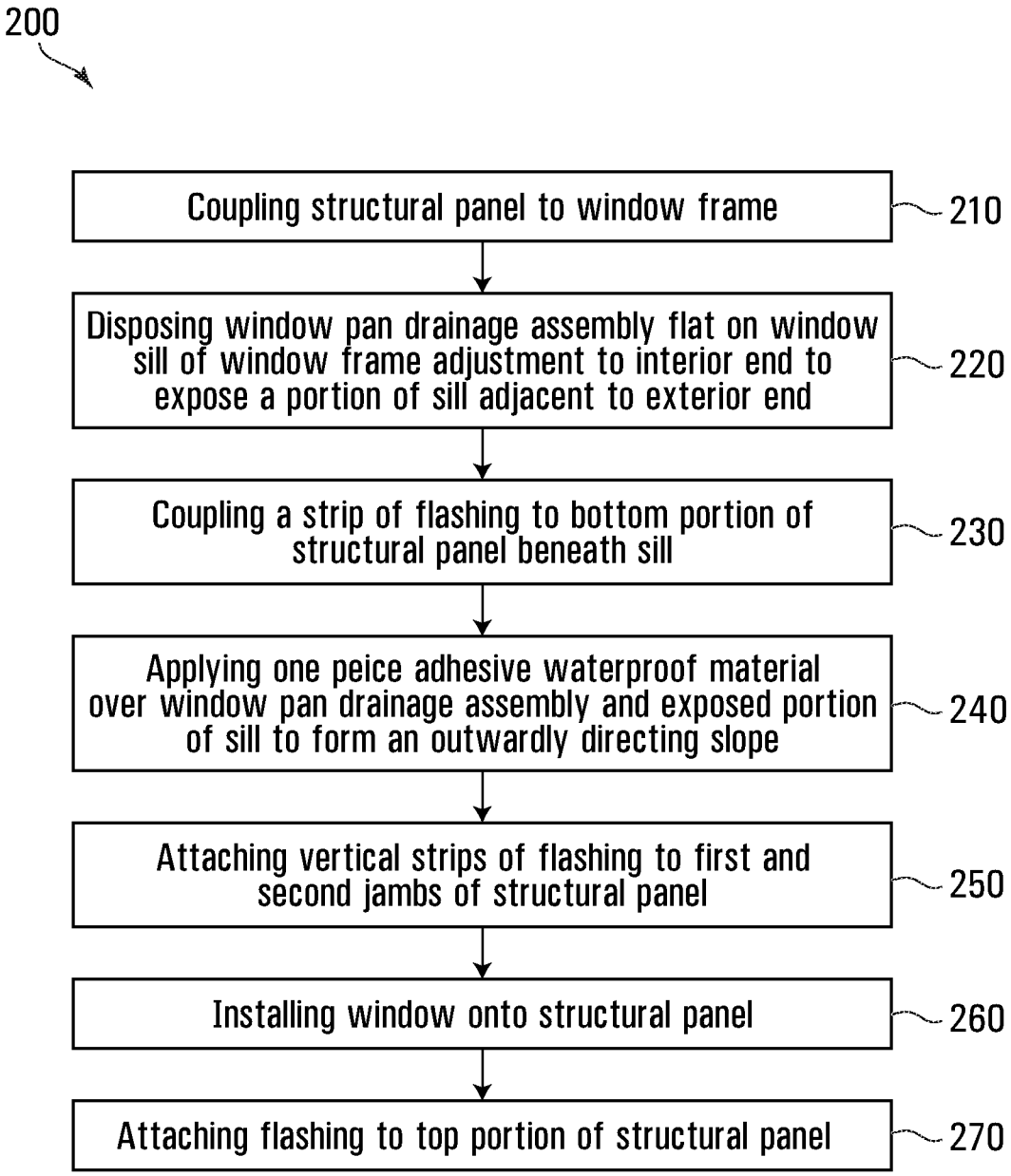
FIG. 18 is a diagram of a method for installing a window and preventing water intrusion.

FIG. 18 illustrates a method 200 for installing a window and preventing water intrusion. The method 200 comprises step 210 of coupling a structural panel to a window frame to align a panel opening with a frame opening. This step 210 may also include trimming the structural panel, which is preferably composed of engineered material such as oriented strand board (OSB), so to conform the panel opening to the frame opening and thereby collectively form a window opening for receiving a window.

Step 220 comprises disposing the window pan drainage system 40 of the present disclosure on a window sill of the window frame adjacent to an interior end of the sill so as to expose an elongate portion of the sill adjacent to an exterior end.

Step 230 comprises coupling a strip of flashing to the bottom portion of the structural panel beneath the sill in a generally horizontal direction.

Step 240 comprises applying a one piece adhesive waterproof material over the window pan drainage system (or coupling multiple pieces of flashing tape or a trowel on a liquid applied membrane) and exposed portion of the window sill to form an outwardly directing slope.

In step 250, strips of flashing are applied in a vertical orientation along the jambs of the structural panel (or coupling multiple pieces of flashing tape or a trowel on a liquid applied membrane). The vertical flashing strips are preferably coupled at medial sections adjacent to the panel opening.

Step 260 comprises installing a window onto an exterior side of the structural panel opposite the window frame.

In step 270, a flashing strip is coupled to a top portion of the structural panel in a generally horizontal direction.

According to yet another embodiment, there is provided a kit including instructions for installing the window pan drainage system on a window frame for protecting a building structure. The kit includes at least one sill strip of the present disclosure constructed to be placed at a middle region of a window sill of the window frame; at least one right corner dam of the present disclosure constructed to be placed at a right region of the window sill of the window frame; at least one left corner dam of the present disclosure constructed to be placed at a left region of the window sill of the window frame, at least one shim of the present disclosure constructed to be placed in between a bottom surface of the sill strip and/or bottom surface of the right corner dam and/or bottom surface of the left corner dam and the middle region and/or right region and/or left region of the window sill and a container or package for holding each of the at least one sill strip, right corner dam, left corner dam and shim.

While the foregoing is directed to embodiments of the present disclosure, other and further embodiments of the disclosure may be devised without departing from the basic scope thereof, and the scope thereof is determined by the claims that follow.

The invention claimed is:

1. A window pan drainage system comprising:

a) a sill strip including a top surface sloped relative to a horizontal plane defined by a length direction and a width direction and a bottom surface comprising a plurality of first rib structures spaced apart from each other and configured to support the sill strip, and wherein the plurality of first rib structures are positioned along substantially all of the width direction of the bottom surface and extend from a back end of the sill strip to a front end of the sill strip;

b) a right corner dam having an L-configuration including a lower top surface sloped relative to a horizontal plane defined by the length direction and the width direction, an upper top surface sloped relative to a vertical plane defined by a height direction and the width direction, a lower bottom surface comprising a plurality of second rib structures spaced apart from each other and an upper bottom surface comprising a plurality of third rib structures spaced apart from each other, the second and third rib structures configured to support the right corner dam; and c) a left corner dam having an L-configuration including a lower top surface sloped relative to a horizontal plane defined by the length direction and the width direction, an upper top surface sloped relative to the vertical plane, a lower bottom surface comprising a plurality of fourth rib structures spaced apart from each other and an upper bottom surface comprising a plurality of fifth rib structures spaced apart from each other, the fourth and fifth rib structures configured to support the right corner dam.

2. The window pan drainage system of claim 1, wherein the upper top surface of the right corner dam and the upper top surface of the left corner dam are sloped at an angle of less than 10° relative to the vertical plane.

3. The window pan drainage system of claim 2, wherein the upper top surface of the right corner dam and the upper top surface of the left corner dam are continuously sloped.

4. The window pan drainage system of claim 1, wherein the top surface of the sill strip, the lower bottom surface of the right corner dam and the lower bottom surface of the left corner dam are sloped at an angle of less than 10° relative to the horizontal plane defined by the length direction and the width direction.

5. The window pan drainage system of claim 4, wherein the top surface of the sill strip, the lower bottom surface of the right corner dam and the lower bottom surface of the left corner dam are continuously sloped.

6. The window pan drainage system of claim 1, wherein a spacing between the plurality of first rib structures is substantially identical and a spacing between the plurality of second rib structures is substantially identical.

7. The window pan drainage system of claim 6, wherein the spacing between the plurality of first rib structures creates a plurality of sill strip cavities, the plurality of sill strip cavities configured to allow insulation to be inserted therein.

8. The window pan drainage system of claim 6, wherein the plurality of second rib structures and the plurality of third rib structures are positioned along substantially all of the width direction of the lower bottom surface and the upper bottom surface of the right corner dam and extend from a back end of the right corner dam to a front end of the right corner dam.

9. The window pan drainage system of claim 8, wherein a spacing between the plurality of second rib structures and the plurality of the third rib structures creates a plurality of right corner dam cavities, the right corner dam cavities configured to allow insulation to be inserted therein.

10. The window pan drainage system of claim 8, wherein the plurality of fourth rib structures and the plurality of fifth rib structures are positioned along substantially all of the width direction of the lower bottom surface and the upper bottom surface of the left corner dam and extend from a back end of the left corner dam to a front end of the left corner dam.

11. The window pan drainage system of claim 10, wherein a spacing between the plurality of fourth rib structures and the plurality of fifth rib structures creates a plurality of left corner dam cavities, the left corner dam cavities configured to allow insulation to be inserted therein.

12. The window pan drainage system of claim 1, wherein the sill strip has a length of between about 10 inches to about 40 inches.

13. The window pan drainage system of claim 1, wherein the sill strip has about 4 to about 12 first rib structures.

14. The window pan drainage system of claim 1, wherein the right corner dam and the left corner dam each have a length of from about 2 inches to about 30 inches and a height of from about 2 inches to about 8 inches.

15. The window pan drainage system of claim 1, wherein the right corner dam has less than 12 second and third rib structures and the left corner dam has less than 12 fourth and fifth rib structures.

16. The window pan drainage system of claim 1, wherein the sill strip, right corner dam and left corner dam each comprise a fastener locator or aperture.

17. The window pan drainage system of claim 1, wherein the window pan drainage system further comprise one or more shims operable to level the window pan drainage system when installed in a window sill.

18. The window pan drainage system of claim 17, wherein the one or more shims have a height of about 0.125 inches or about 0.375 inches.

19. A method for preventing water intrusion for a window assembly having a window sill with an interior-facing side and an exterior-facing side comprising:

a) placing the water pan drainage system of claim 1 horizontally flat on the window sill so that the upper top surface of the sill strip, the upper and lower top surfaces of the right corner dam and the upper and lower bottom top surfaces of the left corner dam slope towards the exterior-facing side; and b) coupling the water pan drainage system to the window sill.

* * * * *